US009858818B2

(12) United States Patent
Shibata et al.

(10) Patent No.: US 9,858,818 B2
(45) Date of Patent: Jan. 2, 2018

(54) TERMINAL DEVICE

(71) Applicant: Panasonic Intellectual Property Management Co., Ltd., Osaka (JP)

(72) Inventors: Teppei Shibata, Gifu (JP); Hiroshi Takemura, Aichi (JP); Takao Mizuguchi, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 75 days.

(21) Appl. No.: 14/938,464

(22) Filed: Nov. 11, 2015

(65) Prior Publication Data

US 2016/0148511 A1 May 26, 2016

(30) Foreign Application Priority Data

Nov. 20, 2014 (JP) ..... 2014-235741

(51) Int. Cl.
*G08G 1/16* (2006.01)
*G08G 1/01* (2006.01)
*G08G 1/056* (2006.01)

(52) U.S. Cl.
CPC ..... *G08G 1/162* (2013.01); *G08G 1/0116* (2013.01); *G08G 1/056* (2013.01); *G08G 1/166* (2013.01)

(58) Field of Classification Search
CPC ..... G08G 1/162; G08G 1/166; G08G 1/0166; G08G 1/056
See application file for complete search history.

(56) References Cited

U.S. PATENT DOCUMENTS

2012/0025965 A1* 2/2012 Mochizuki ..... B60Q 9/008 340/435
2016/0001693 A1* 1/2016 Tamura ..... G01C 21/3632 340/441
2016/0004418 A1* 1/2016 Lee ..... B60K 35/00 715/765
2016/0148511 A1 5/2016 Shibata et al.

FOREIGN PATENT DOCUMENTS

JP 2002-340583 11/2002
JP 2004-077281 3/2004
JP 2010-146459 7/2010
JP 2010-247656 11/2010
JP 2011-053799 3/2011
JP 5880904 B 3/2016

* cited by examiner

*Primary Examiner* — Anne M Antonucci
(74) *Attorney, Agent, or Firm* — McDermott Will & Emery LLP

(57) ABSTRACT

A first terminal device is disclosed that is mountable in a first vehicle. The first terminal device comprises: an acquirer that acquires first information on the first vehicle; a receiver that receives a packet signal from a second terminal device, the packet signal including second information on a second vehicle in which the second terminal device is mounted; a controller that selects a first plurality of driving supports that are capable of being provided to a driver of the first vehicle among a second plurality of driving supports, based on the first information and the second information; and a display that displays each of images representing each of the first plurality of the driving supports in more detail as priority given to each of the first plurality of the driving supports is higher.

17 Claims, 24 Drawing Sheets

FIG. 16

82

| DEGREE OF RISK | SUPPORT |
|---|---|
| 1 | RIGHT-TURN COLLISION PREVENTION SUPPORT / RIGHT-TURN COLLISION PREVENTION SUPPORT FOR VEHICLE AND/OR PEDESTRIAN / LEFT-TURN COLLISION PREVENTION SUPPORT / LEFT-TURN COLLISION PREVENTION SUPPORT FOR VEHICLE AND/OR PEDESTRIAN / CROSSING COLLISION PREVENTION SUPPORT / REAR-END COLLISION PREVENTION SUPPORT / EMERGENCY BRAKE NOTIFICATION SUPPORT / SIGNAL RECOGNITION ENHANCEMENT SUPPORT |
| 2 | EMERGENCY VEHICLE APPROACHING SUPPORT |
| 3 | SURROUNDING EVENT NOTIFICATION SUPPORT |
| 4 | SIGNAL PASSING SUPPORT / SIGNAL STOPPING SUPPORT / IDLING STOP SUPPORT / SIGNAL CHANGE STARTING SUPPORT / MODERATE ACCELERATION SUPPORT |

FIG. 17

86

| ITEM | CONTENTS |
|---|---|
| 1 | DETECTED IS VULNERABLE ROAD USER (PEDESTRIAN OR BICYCLE) |
| 2 | DETECTED IS TWO-WHEEL VEHICLE |
| 3 | DETECTED IS LARGE-SIZED VEHICLE |
| 4 | VEHICLE TYPE OF HOST VEHICLE<br>· IN CASE WHERE HOST VEHICLE IS LARGE-SIZED VEHICLE, LEFT-TURN COLLISION PREVENTION SUPPORT AND REAR-END COLLISION PREVENTION SUPPORT ARE PREFERENTIALLY EXECUTED |
| 5 | VEHICLE TYPE AND FEATURE OF HOST VEHICLE<br>· IN CASE WHERE HEIGHT OF DRIVER'S SEAT IS HIGH, REAR-END COLLISION PREVENTION SUPPORT AND EMERGENCY BRAKE NOTIFICATION SUPPORT ARE PREFERENTIALLY EXECUTED<br>· IN CASE WHERE DISTANCE FROM DRIVER'S SEAT TO FRONT END OF VEHICLE IS LONG, CROSSING COLLISION PREVENTION SUPPORT IS PREFERENTIALLY EXECUTED |
| 6 | SUPPORT SCENE WHERE ACCIDENT FREQUENTLY OCCURS BASED ON PAST ACCIDENT LOG AT SAME POINT |
| 7 | SCENE WHERE VIEWABILITY IS LOW SUCH AS BAD WEATHER, NIGHTTIME, OR DUSK, AND OTHER VEHICLE IS TRAVELING WITHOUT LIGHT |
| 8 | IN ACCORDANCE WITH DRIVER'S RESPONSE LEVEL IN PAST SIMILAR SCENE (PREFERENTIALLY EXECUTED IN CASE WHERE RESPONSE LEVEL IS POOR) |
| 9 | PREFERENTIALLY EXECUTED IN CASE WHERE RESPONSE LEVEL OF DRIVER OF OTHER VEHICLE IS POOR |
| 10 | LEVEL OF SKILL OF DRIVER OF OTHER VEHICLE (PREFERENTIALLY EXECUTED IN CASE WHERE DRIVER OF OTHER VEHICLE IS BEGINNER OR ELDERLY PERSON) |
| 11 | LEVEL OF WAKEFULNESS OF DRIVER OF OTHER VEHICLE (PREFERENTIALLY EXECUTED IN CASE WHERE LEVEL OF WAKEFULNESS IS LOW) |
| 12 | PREFERENTIALLY EXECUTED IN CASE WHERE FREQUENCY OF DRIVING OF DRIVER OF OTHER VEHICLE IS LOW |
| 13 | PREFERENTIALLY EXECUTED IN CASE WHERE SPEED OF OTHER VEHICLE IS HIGHER |
| 14 | PREFERENTIALLY EXECUTED IN CASE WHERE BRAKING DISTANCE OF OTHER VEHICLE IS LONGER |
| 15 | CONSIDER DRIVER'S LINE OF SIGHT (PREFERENTIALLY EXECUTED IN CASE WHERE DRIVER IS NOT LOOKING) |
| 16 | PREFERENTIALLY EXECUTED IN CASE WHERE OTHER VEHICLE IS LEFT-HAND DRIVE VEHICLE |
| 17 | PRESENCE OR ABSENCE OF VEHICLE AHEAD OF OTHER VEHICLE (PREFERENTIALLY EXECUTED IN CASE WHERE THERE IS NO VEHICLE AHEAD OF OTHER VEHICLE) |

70

TERMINAL DEVICE

BACKGROUND

1. Technical Field

The present disclosure relates to a communication technique. More specifically, the present disclosure relates to a terminal device that receives a signal including predetermined information.

2. Description of the Related Art

A wireless communication device (terminal device) receives information transmitted from another vehicle that is traveling. The wireless communication device determines the necessity of a driving support on the basis of the received information and provides a driver with the driving support (see, for example, Japanese Unexamined Patent Application Publication No. 2010-247656).

In a case where conditions of occurrence of a plurality of supports are met concurrently, there is a risk of confusion of a driver if all of the supports are provided to the driver, but if only one of the supports is provided to the driver, there is a risk of being late for responding to the concurrently-occurring supports that are provided subsequently to this support.

SUMMARY

One non-limiting and exemplary embodiment provides a technique for selecting two or more supports appropriate for a driver and presenting the selected two or more supports to the driver in accordance with a situation in which the driver is placed in a case where a plurality of supports occur.

In one general aspect, the techniques disclosed here feature a first terminal device that is mountable in a first vehicle, including: an acquirer that acquires first information on the first vehicle in which the first terminal device is mounted; a receiver that receives a packet signal from a second terminal device via inter-terminal-device communication, the packet signal including second information on a second vehicle in which the second terminal device is mounted; a controller that selects a first plurality of driving supports that are capable of being provided to a driver of the first vehicle among a second plurality of driving supports, on the basis of the acquired first information and the second information included in the received packet signal, wherein the number of the second plurality of the driving supports is equal to or larger than the number of the first plurality of the driving supports; and a display that displays each of images representing each of the first plurality of the driving supports in more detail as priority given to each of the first plurality of the driving supports is higher.

According to the present disclosure, it is possible to select two or more supports appropriate for a driver and present the selected two or more supports to the driver in accordance with a situation in which the driver is placed in a case where a plurality of supports occur.

These general and specific aspects may be implemented using a system, a method, and a computer program, and any combination of systems, methods, and computer programs.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 16 is a diagram illustrating a data structure of a table stored in a classification unit in FIG. 4;

FIG. 17 is a diagram illustrating a data structure of a table stored in a priority determination unit in FIG. 4;

DETAILED DESCRIPTION

Figure 1:
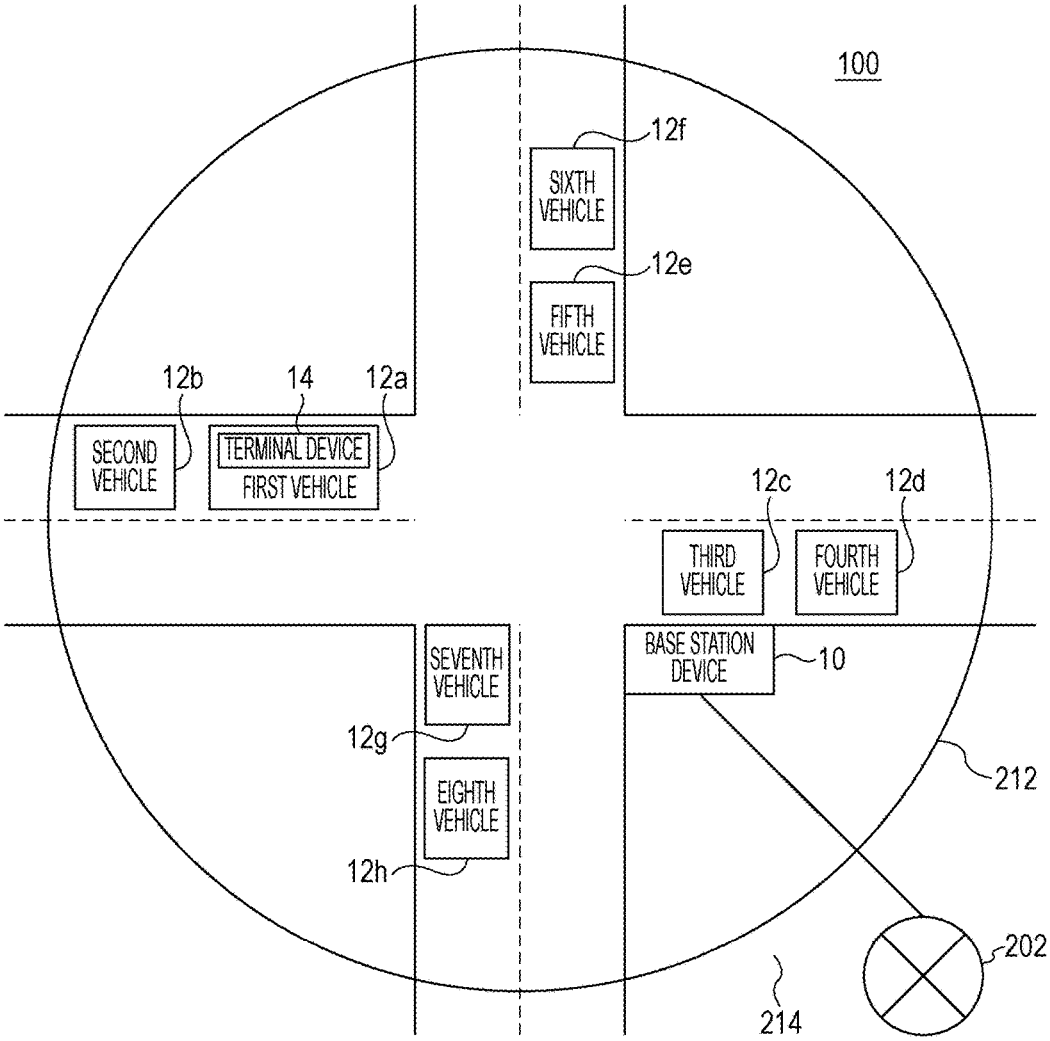
FIG. 1 is a diagram illustrating a configuration of a communication system according to an embodiment of the present disclosure.

Underlying knowledge forming the basis of the present disclosure is described below before a specific embodiment of the present disclosure is described. The embodiment of the present disclosure relates to a communication system in which inter-vehicle communication between terminal devices mounted in vehicles is performed and in which roadside-to-vehicle communication from a base station device provided at an intersection or the like to a terminal device is also performed. Such a communication system is also called ITS (Intelligent Transport Systems). The communication system uses an access control function called CSMA/CA (Carrier Sense Multiple Access with Collision Avoidance) in a similar manner to wireless LAN (Local Area Network) that is compliant with a standard such as IEEE802.11. Therefore, an identical wireless channel is shared by a plurality of terminal devices. Meanwhile, in ITS, it is necessary to transmit information to an indefinitely large number of terminal devices. In order to efficiently perform such transmission, the present communication system broadcasts a packet signal.

That is, a terminal device broadcasts, as inter-vehicle communication, a packet signal in which information such as the position, speed, or traveling direction of a vehicle is stored. Another terminal device receives the packet signal and recognizes the approach or the like of the vehicle on the basis of the information. In order to reduce interference between roadside-to-vehicle communication and inter-vehicle communication, a base station device repeatedly defines a frame including a plurality of sub-frames. The base station device selects, for roadside-to-vehicle communication, any of the plurality of sub-frames, and broadcasts a packet signal in which control information and the like are stored during a period corresponding to the start portion of the selected sub-frame.

The control information includes information concerning a period (hereinafter referred to as a "roadside-to-vehicle communication period") for broadcast transmission of the packet signal by the base station device. A terminal device specifies a roadside-to-vehicle communication period on the basis of the control information and then broadcasts a packet signal by the CSMA method during a period (hereinafter referred to as an "inter-vehicle communication period") other than the roadside-to-vehicle communication period. As a result, the roadside-to-vehicle communication and the inter-vehicle communication are time-division multiplexed. Note that a terminal device that cannot receive the control information from the base station device, i.e., a terminal device that is out of an area formed by the base station device transmits a packet signal by the CSMA method irrespective of the configuration of the frame.

Under such a situation, a terminal device according to the present embodiment derives a support that meets a support occurrence condition on the basis of information included in a packet signal received from another terminal device or a base station device. Note that the terminal device and the base station device are collectively referred to as a "wireless communication device", and the base station device is sometimes referred to as a roadside device. The present terminal device and a vehicle in which the present terminal device is mounted are collectively referred to as a "host vehicle", and other terminal devices and vehicles in which other terminal devices are mounted are collectively referred to as "other vehicles". The information included in the packet signal is, for example, information on the state of the vehicle transmitted from the other terminal device, information on the state of the vehicle, information on a road shape, or signal information transmitted from the base station device. The "support" refers to a support of driver's driving and is, for example, notification of the presence of another vehicle coming from the opposite direction at a right turn of a host vehicle.

Plural kinds of supports are defined, and a support occurrence condition is defined for each of the supports. There are cases where a plurality of support occurrence conditions are met at a predetermined timing. In a case where a plurality of supports are provided concurrently, a driver is sometimes unsure about which support should be followed. It is therefore desirable that in a case where a plurality of supports occur, the driver be notified of priorities of these supports. Meanwhile, in a case where a plurality of supports occur at the same timing, the driver may be notified of only a support that is given a high priority in advance. However, in a case where supports of the same priority occur, a support that should be displayed cannot be determined. For example, there are cases where the order of priorities cannot be easily determined such as a case where a crossing collision prevention support and a right-turn collision prevention support occur. Furthermore, in a case where only one of the supports is provided, there is a risk of delay of driver's response to a concurrently-occurring support that is provided subsequently to the support.

In order to cope with such situations, the terminal device according to the present embodiment determines whether or not a support occurrence condition is met on the basis of information on the position, speed, traveling direction, and the state of a host vehicle and information on the position, speed, traveling direction, and the state of other vehicles. Furthermore, the terminal device determines whether or not a support occurrence condition is met on the basis of the information on the position, speed, traveling direction, and the state of the host vehicle, road shape information, signal information, vehicle detection information, pedestrian detection information, service information, and emergency vehicle approaching information provided by a roadside device. In a case where a support occurrence condition is met, at least a support classified in a group with the highest degree of risk is selected from among supports that are classified depending on the degree of risk in advance. Furthermore, a period of time T to occurrence of an even indicated by support contents of the selected support is calculated. Furthermore, the terminal device selects two or more supports that should be provided to a driver in accordance with priorities based on a support situation from among all supports that satisfy the support occurrence condition and whose period of time T is equal to or lower than a threshold value. Finally, the terminal device displays a support with a high priority and concurrently displays concurrently-occurring supports (supports of which the driver is notified at the same timing) in a simple way as icons regardless of the period of time T.

FIG. 1 illustrates a configuration of a communication system 100 according to the embodiment of the present disclosure. FIG. 1 illustrates an intersection viewed from above. The communication system 100 includes a base station device 10; a first vehicle 12*a*, a second vehicle 12*b*, a third vehicle 12*c*, a fourth vehicle 12*d*, a fifth vehicle 12*e*, a sixth vehicle 12*f*, a seventh vehicle 12*g*, and an eighth vehicle 12*h*, which are collectively referred to as vehicles 12; and a network 202. In FIG. 1, only a terminal device 14 mounted in the first vehicle 12*a* is illustrated, but a terminal device 14 is mounted in each of the vehicles 12. Furthermore, an area 212 is formed around the base station device 10, and an outside area 214 is formed outside the area 212.

As illustrated in FIG. 1, a road extending in a horizontal direction, i.e., a left-right direction of FIG. 1 crosses, at a central part, a road extending in a vertical direction, i.e., an top-bottom direction of FIG. 1. In FIG. 1, the top side corresponds to "north", the left side corresponds to "west", the bottom side corresponds to "south", and the right side corresponds to "east". A part at which these two roads cross each other is an "intersection". The first vehicle 12*a* and the second vehicle 12*b* are traveling from left to right, and the third vehicle 12*c* and the fourth vehicle 12*d* are traveling from right to left. The fifth vehicle 12*e* and the sixth vehicle 12*f* are traveling from top to bottom, and the seventh vehicle 12*g* and the eighth vehicle 12*h* are traveling from bottom to top.

In the communication system 100, the base station device 10 is fixedly installed at the intersection. The base station device 10 controls communication between the terminal devices. The base station device 10 repeatedly generates a frame including a plurality of sub-frames on the basis of a signal received from a GPS (Global Positioning System) satellite (not illustrated) or a frame formed by another base station device 10 (not illustrated). It is specified that a roadside-to-vehicle communication period can be set at the start of each of the sub-frames.

The base station device 10 selects a sub-frame in which no roadside-to-vehicle communication period is set by another base station device 10 from the plurality of sub-frames included in the frame. The base station device 10 sets a roadside-to-vehicle communication period at the start of the selected sub-frame. The base station device 10 broadcasts a packet signal during the set roadside-to-vehicle communication period. A plurality of packet signals may be broadcast during the roadside-to-vehicle communication period. The packet signal includes, for example, accident information, traffic jam information, and signal information. Note that the packet signal also includes information concerning a timing at which the roadside-to-vehicle communication period is set and control information concerning the frame.

The terminal device 14 is mounted in each of the vehicles 12 as described above and can therefore be transported. Upon receipt of the packet signal from the base station device 10, the terminal device 14 estimates that the terminal device 14 is within the area 212. In a case where the terminal device 14 is within the area 212, the terminal device 14 generates a frame on the basis of control information included in the packet signal, especially information concerning a timing at which the roadside-to-vehicle communication period is set and information concerning the frame. As a result, the frame generated in each of the plurality of terminal devices 14 is in sync with the frame generated in the base station device 10. The terminal device 14 broadcasts a packet signal during an inter-vehicle communication period that is different from the roadside-to-vehicle communication period. During the inter-vehicle communication period, CSMA/CA is performed. Meanwhile, in a case where the terminal device 14 estimates that the terminal device 14 is within the outside area 214, the terminal device 14 broadcasts a packet signal by performing CSMA/CA irrespective of the configuration of the frame. The terminal device 14 recognizes an approach or the like of a vehicle 12 in which another terminal device 14 is mounted on the basis of a packet signal from the other terminal device 14.

Figure 2:
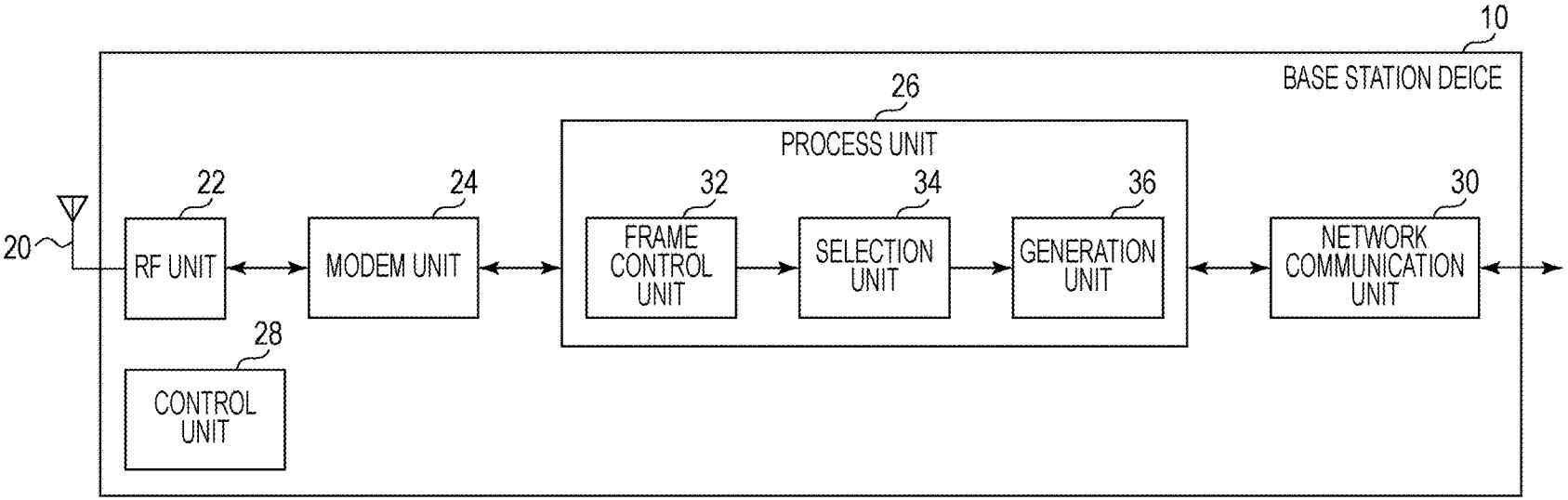
FIG. 2 is a diagram illustrating a configuration of a base station device in FIG. 1.

FIG. 2 illustrates a configuration of the base station device 10. The base station device 10 includes an antenna 20, an RF unit 22, a modem unit 24, a process unit 26, a control unit 28, and a network communication unit 30. The process unit 26 includes a frame control unit 32, a selection unit 34, and a generation unit 36.

The RF unit 22 receives, as a receiving process, a packet signal from a terminal device 14 or another base station device 10 (not illustrated) via the antenna 20. The RF unit 22 converts the frequency of the received wireless frequency packet signal to generate a baseband packet signal. Furthermore, the RF unit 22 supplies the baseband packet signal to the modem unit 24. In general, the baseband packet signal is made up of an in-phase component and an orthogonal component, and therefore two signal lines should be illustrated. However, for clarity in FIG. 2, only one signal line is illustrated. The RF unit 22 includes an LNA (Low Noise Amplifier), a mixer, an AGC, and an A/D converter unit.

The RF unit 22 converts, as a transmitting process, the frequency of the baseband packet signal supplied from the modem unit 24 to generate a wireless frequency packet signal. Furthermore, the RF unit 22 transmits the wireless frequency packet signal via the antenna 20 during the roadside-to-vehicle communication period. The RF unit 22 includes a PA (Power Amplifier), a mixer, and a D/A converter unit.

The modem unit 24 demodulates, as a receiving process, the baseband packet signal from the RF unit 22. Furthermore, the modem unit 24 supplies a demodulation result to the process unit 26. Moreover, the modem unit 24 modulates, as a transmitting process, data from the process unit 26. Furthermore, the modem unit 24 supplies, as a baseband packet signal, a modulation result to the RF unit 22. Since the communication system 100 supports an OFDM (Orthogonal Frequency Division Multiplexing) modulation method, the modem unit 24 also performs, as a receiving process, FFT (Fast Fourier Transform) and performs, as a transmitting process, IFFT (Inverse Fast Fourier Transform).

The frame control unit 32 receives a signal from a GPS satellite (not illustrated) and acquires time information on the basis of the received signal. Note that acquisition of the time information can be performed by using a known art, and description thereof is omitted. The frame control unit 32 generates a plurality of frames on the basis of the time information. For example, the frame control unit 32 generates 10 frames of "100 msec" by dividing a period of "1 sec" into 10 sections on the basis of a timing indicated in the time information. By repeating such a process, a frame is repeatedly defined. Note that the frame control unit 32 may detect control information from the demodulation result and generate a frame on the basis of the detected control information. Such a process corresponds to generating a frame that is in sync with a timing of a frame generated by another base station device 10.

Figure 3:
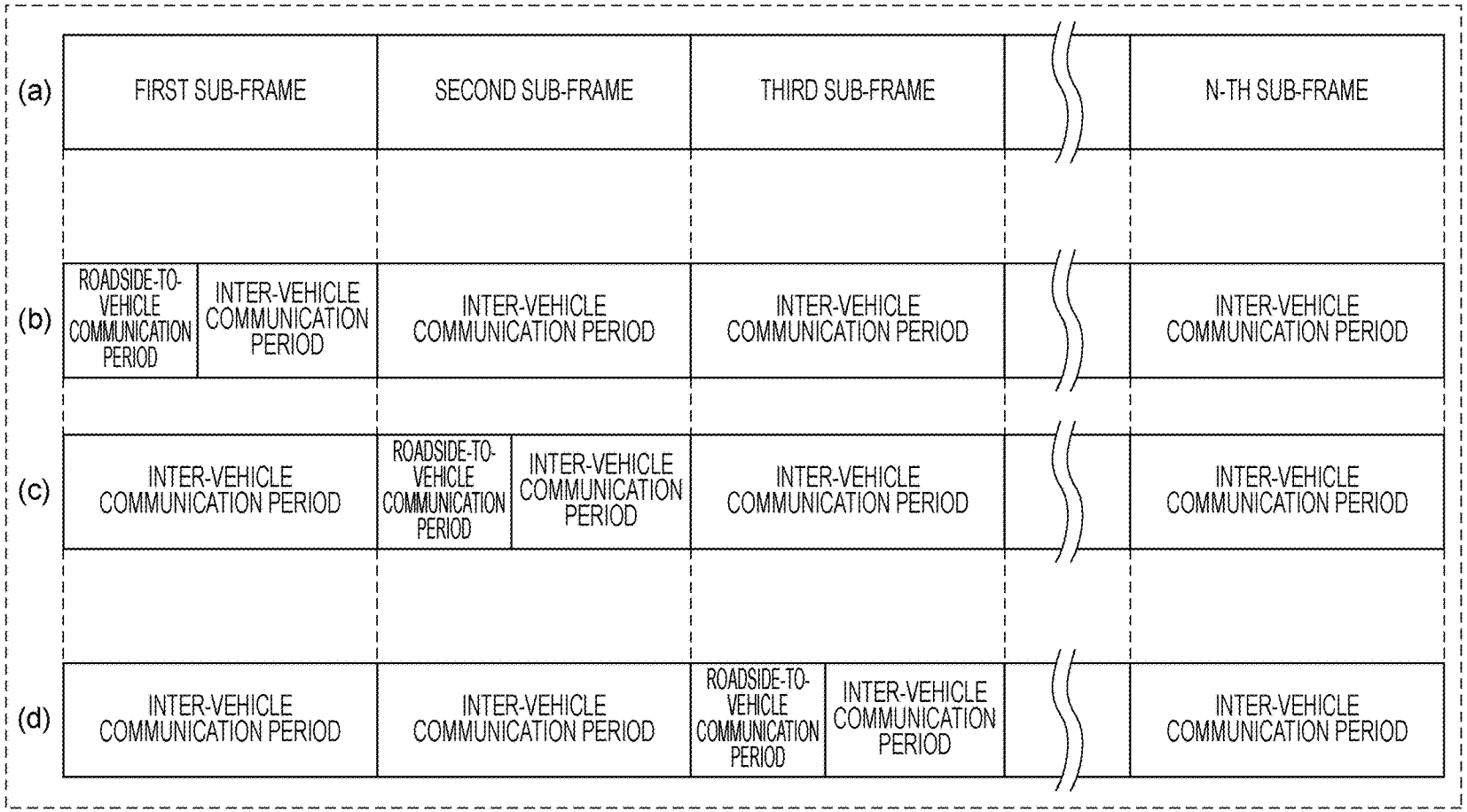
FIG. 3 is a diagram illustrating a format of a frame defined in the communication system in FIG. 1.

FIG. 3 illustrates a format of a frame defined in the communication system 100. FIG. 3(*a*) illustrates a configuration of the frame. The frame is made up of N sub-frames, i.e., the first sub-frame through the N-th sub-frame. That is, it can be said that the frame is formed by time-multiplexing a plurality of sub-frames that can be used for broadcast of a packet signal by the terminal device 14. For example, in a case where the length of the frame is 100 msec and where N is 8, sub-frames each having a length of 12.5 msec are defined. N may be a number other than 8. FIGS. 3(*b*) through 3(*d*) are described later. The following description returns to FIG. 2.

The selection unit 34 selects a sub-frame in which a roadside-to-vehicle communication period should be set from among the plurality of sub-frames included in the frame. Specifically, the selection unit 34 accepts the frame specified by the frame control unit 32. Furthermore, the selection unit 34 accepts an instruction concerning the selected sub-frame via an interface (not illustrated). The selection unit 34 selects a sub-frame corresponding to the instruction. Separately from this, the selection unit 34 may automatically select a sub-frame. In this case, the selection unit 34 receives a demodulation result from another base station device 10 or the terminal device 14 (not illustrated) via the RF unit 22 and the modem unit 24. The selection unit 34 extracts the demodulation result received from another base station device 10. The selection unit 34 specifies a sub-frame for which the demodulation result has not been accepted by specifying a sub-frame for which the demodulation result has been accepted.

This corresponds to specifying a sub-frame in which a roadside-to-vehicle communication period has not been set by another base station device 10, i.e., a unused sub-frame. In a case where there are a plurality of unused sub-frames, the selection unit 34 randomly selects one sub-frame. In a case where there is no unused sub-frame, i.e., in a case where each of the plurality of sub-frames is being used, the selection unit 34 acquires reception electric power corresponding to the demodulation result and preferentially selects a sub-frame of small reception electric power.

FIG. 3(*b*) illustrates a configuration of a frame generated by a first base station device 10*a* (not illustrated). The first base station device 10*a* sets a roadside-to-vehicle communication period at the start of a first sub-frame.

Furthermore, the first base station device 10*a* sets an inter-vehicle communication period in a period of the first sub-frame excluding a roadside-to-vehicle communication period and in the second to N-th sub-frames. The inter-vehicle communication period is a period in which the terminal device 14 can broadcast a packet signal. That is, it is specified that the first base station device 10*a* can broadcast a packet signal during the roadside-to-vehicle communication period, which is the start of the first sub-frame, and the terminal device 14 can broadcast a packet signal during an inter-vehicle communication period other than the roadside-to-vehicle communication period in the frame.

FIG. 3(*c*) illustrates a configuration of a frame generated by a second base station device 10*b* (not illustrated). The second base station device 10*b* sets a roadside-to-vehicle communication period at the start of a second sub-frame. Furthermore, the second base station device 10*b* sets an inter-vehicle communication period in a period of the second sub-frame excluding the roadside-to-vehicle communication period, the first sub-frame, and the third sub-frame through the N-th sub-frame. FIG. 3(*d*) illustrates a configuration of a frame generated by a third base station device 10*c* (not illustrated). The third base station device 10*c* sets a roadside-to-vehicle communication period at the start of the third sub-frame. Furthermore, the third base station device 10*c* sets an inter-vehicle communication period in a period of the third sub-frame excluding the roadside-to-vehicle communication period, the first sub-frame, the second sub-frame, and the fourth sub-frame through the N-th sub-frame. In this way, the plurality of base station devices 10 select different sub-frames and set a roadside-to-vehicle communication period at the start of the selected sub-frames. The following description returns to FIG. 2. The selection unit 34 supplies a number of the selected sub-frame to the generation unit 36.

The generation unit 36 receives the number of the sub-frame from the selection unit 34. The generation unit 36 sets a roadside-to-vehicle communication period in the sub-frame having the received sub-frame number, and generates a packet signal that should broadcast in the roadside-to-vehicle communication period. In a case where a plurality of packet signals are transmitted during one roadside-to-vehicle communication period, the generation unit 36 generates these packet signals. A packet signal is made up of control information and a payload. The control information includes, for example, a number of a sub-frame in which a roadside-to-vehicle communication period has been set. The payload includes, for example, accident information, traffic jam information, and signal information. These data are acquired from the network 202 (not illustrated) by the network communication unit 30. The process unit 26 causes the modem unit 24 and the RF unit 22 to broadcast a packet signal during the roadside-to-vehicle communication period. The control unit 28 controls the process of the whole base station device 10.

This configuration is realized by a CPU, memory, and other LSI of any computer in the case of hardware and is realized by a program loaded to memory in the case of software. In FIG. 2, functional blocks realized by cooperation of these are illustrated. Therefore, it is understood by a person skilled in the art that these functional blocks are realized in various forms by hardware only or by a combination of hardware and software.

Figure 4:
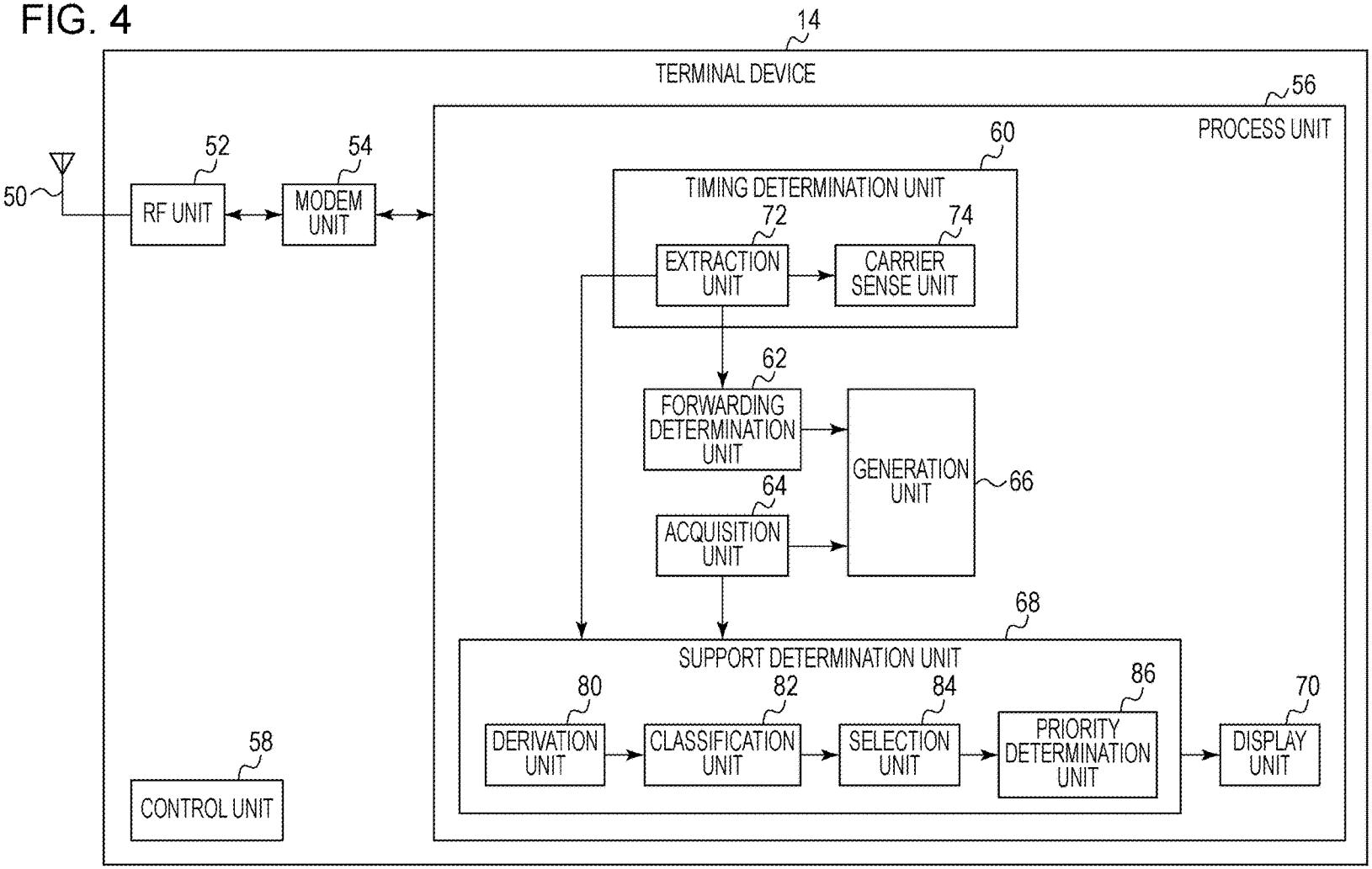
FIG. 4 is a diagram illustrating a configuration of a terminal device in FIG. 1.

FIG. 4 illustrates a configuration of the terminal device 14. The terminal device 14 includes an antenna 50, an RF unit 52, a modem unit 54, a process unit 56, and a control unit 58. The process unit 56 includes a timing determination unit 60, a forwarding determination unit 62, an acquisition unit 64, a generation unit 66, a support determination unit 68, and a display unit 70. The timing determination unit 60 includes an extraction unit 72 and a carrier sense unit 74. The support determination unit 68 includes a derivation unit 80, a classification unit 82, a selection unit 84, and a priority determination unit 86. The terminal device 14 can be mounted in each of the vehicles 12 as described above. The antenna 50, the RF unit 52, and the modem unit 54 perform similar processes to the antenna 20, the RF unit 22, and the modem unit 24 of FIG. 2. The following discusses mainly differences.

The modem unit 54 and the process unit 56 receive, in a receiving process at a 700 MHz band frequency, a packet signal from another terminal device 14 or the base station device 10 (not illustrated). As described above, the modem unit 54 and the process unit 56 receive a packet signal from the base station device 10 during a roadside-to-vehicle communication period, and receive a packet signal from another terminal device 14 during an inter-vehicle communication period. The packet signal from the other terminal device 14 includes at least the current position, traveling direction, traveling speed, and the like (hereinafter referred to as "position information") of another vehicle 12 in which the other terminal device 14 is mounted.

In a case where a demodulation result supplied from the modem unit 54 is a packet signal from the base station device 10 (not illustrated), the extraction unit 72 specifies a timing of a sub-frame in which a roadside-to-vehicle communication period is set. In this case, the extraction unit 72 estimates that the terminal device 14 is within the area 212 of FIG. 1. The extraction unit 72 generates a frame on the basis of the timing of the sub-frame and the contents of a message header of the packet signal, specifically, the contents in the roadside-to-vehicle communication period. Note that generation of the frame is performed in the same manner as the frame control unit 32, and description thereof is omitted. As a result, the extraction unit 72 generates a frame that is in sync with the frame generated in the base station device 10. In a case where a source of broadcast of the packet signal is another terminal device 14, the extraction unit 72 omits a process of generating a synchronized frame, but extracts position information and the like included in the packet signal and supplies the extracted position information and the like to the support determination unit 68. Furthermore, the extraction unit 72 supplies control information included in the packet signal to the forwarding determination unit 62.

Meanwhile, in a case where the packet signal from the base station device 10 is not received, the extraction unit 72 estimates that the terminal device 14 is within the outside area 214 of FIG. 1. In a case where the extraction unit 72 estimates that the terminal device 14 is within the area 212, the extraction unit 72 selects an inter-vehicle communication period. In a case where the extraction unit 72 estimates that the terminal device 14 is within the outside area 214, the extraction unit 72 selects a timing that is not related to the configuration of the frame. In a case where the extraction unit 72 selects the inter-vehicle communication period, the extraction unit 72 supplies information concerning timings of the frame and the sub-frame and the inter-vehicle communication period to the carrier sense unit 74. In a case where the extraction unit 72 selects a timing that is not related to the configuration of the frame, the extraction unit 72 instructs the carrier sense unit 74 to perform carrier sense.

The carrier sense unit 74 accepts the information concerning timings of the frame and the sub-frame and the inter-vehicle communication period from the extraction unit 72. The carrier sense unit 74 determines a transmission timing by starting CSMA/CA during the inter-vehicle communication period. Meanwhile, in a case where the carrier sense unit 74 is instructed by the extraction unit 72 to perform carrier sense that is not related to the configuration of the frame, the carrier sense unit 74 determines a transmission timing by performing CSMA/CA without considering the configuration of the frame. The carrier sense unit 74 notifies the modem unit 54 and the RF unit 52 of the determined transmission timing and causes the modem unit 54 and the RF unit 52 to broadcast a packet signal.

The forwarding determination unit 62 controls transfer of the control information. The forwarding determination unit 62 extracts information to be transferred from the control information. The forwarding determination unit 62 generates information that should be transferred on the basis of the extracted information. Description of this process is omitted. The forwarding determination unit 62 supplies the information that should be transferred, i.e., part of the control information to the generation unit 66.

The acquisition unit 64 includes a GPS receiver, a gyroscope, a vehicle speed sensor, and the like (not illustrated), and acquires the position, travelling direction, traveling speed, and the like (collectively referred to as "position information" as described above) of the vehicle 12 (not illustrated), i.e., the vehicle 12 in which the terminal device 14 is mounted on the basis of data supplied from the GPS receiver, the gyroscope, the vehicle speed sensor, and the like. The current position is indicated by latitude and longitude. The traveling direction is indicated by an azimuth assuming that a clockwise direction from north which is a reference of traveling direction (0 degree) is a positive angle. The acquisition of the current position, travelling direction, traveling speed, and the like can be performed by using a known art, and description thereof is omitted. The acquisition unit 64 is connected to a direction indicator of the vehicle 12 and acquires information on a direction indicated by the direction indicator (hereinafter referred to as "winker information"). The acquisition unit 64 supplies the position information and the winker information to the generation unit 66 and the support determination unit 68.

The generation unit 66 accepts the position information and the winker information from the acquisition unit 64 and accepts part of the control information from the forwarding determination unit 62. The generation unit 66 generates a packet signal including these pieces of information and broadcasts the generated packet signal via the modem unit 54, the RF unit 52, and the antenna 50 at the transmission timing determined by the carrier sense unit 74. This corresponds to inter-vehicle communication.

The derivation unit 80 derives a support that should be provided to a driver of the vehicle 12 among plural kinds of supports on the basis of the information acquired by the acquisition unit 64 and the information supplied from the extraction unit 72. Note that there are cases where one other vehicle becomes a cause of two or more supports. The plural kinds of supports are, for example, (1) a right-turn collision prevention support for vehicle and/or pedestrian, (2) a right-turn collision prevention support, (3) a left-turn collision prevention support for vehicle and/or pedestrian, (4) a left-turn collision prevention support, (5) a crossing collision prevention support, (6) a rear-end collision prevention support, (7) a signal recognition enhancement support, (8) an emergency vehicle approaching support, (9) a surrounding event notification support, (10) an emergency brake notification support, (11) a signal passing/signal stopping support, (12) an idling stop support, (13) a signal change starting support, and (14) a moderate acceleration support. Outlines of these supports, used information, and support occurrence conditions of these supports are described below.

(1) Right-Turn Collision Prevention Support for Vehicle and/or Pedestrian (Roadside-to-Vehicle Communication)

Figure 5:
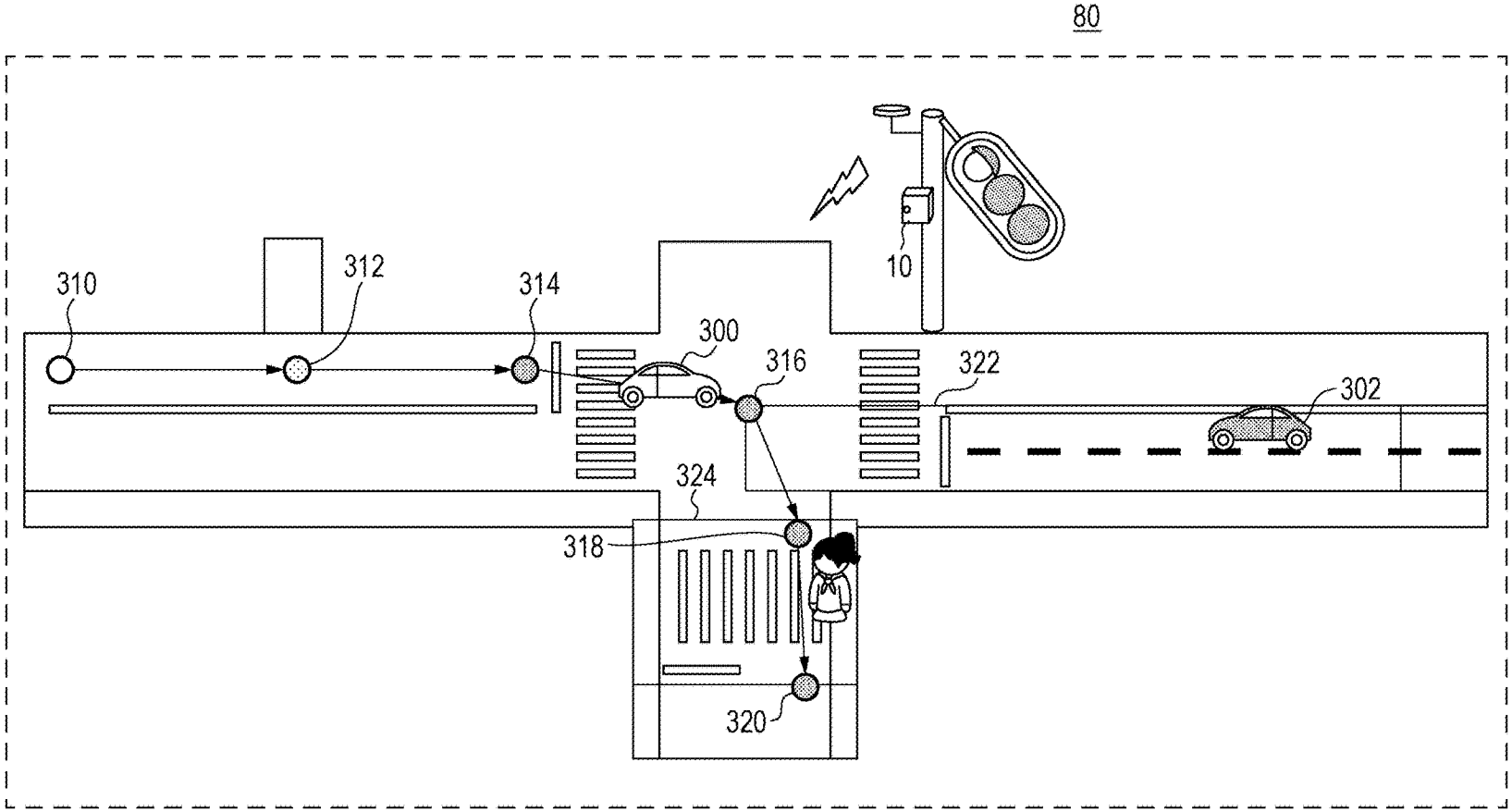
FIG. 5 is a diagram illustrating an outline of (1) a right-turn collision prevention support for vehicle and/or pedestrian in a derivation unit in FIG. 4.

This support notifies a driver of the presence of an approaching vehicle (an oncoming vehicle) in a case where an oncoming vehicle is approaching when a host vehicle makes a right turn or notifies the driver of the presence of a pedestrian in a case where there is a pedestrian on a crosswalk which the host vehicle making a right turn is about to cross. FIG. 5 illustrates an outline of (1) the right-turn collision prevention support for vehicle and/or pedestrian in the derivation unit 80. The base station device 10 is installed in the vicinity of the intersection. The host vehicle 300 is traveling from left to right of FIG. 5, and another vehicle 302 is traveling from right to left of FIG. 5. A start point node 310, a branch node 312, a stop line node 314, an intersection center node 316, a right-turn crosswalk node 318, and a right-turn end node 320 are defined in the traveling direction of the host vehicle 300. Furthermore, a sensor detection area 322 and a pedestrian detection area 324 are set on a road.

The derivation unit 80 acquires, as information from the host vehicle 300, (i) the position, speed, acceleration, and azimuth of the host vehicle 300 from a GPS or an on-board network such as a CAN (Controller Area Network) and (ii) winker information of the host vehicle 300 from the CAN or other means. Furthermore, the derivation unit 80 acquires, as information from the base station device 10, (i) road shape information, which is information on the position of the intersection and the road shape, (ii) service information, which is information on a provided service and a road to which the service is provided, (iii) signal information, which is information on the current color of a traffic signal, a remaining time for which the current color is displayed, the color of the traffic light to be displayed next, and the like, (iv) vehicle detection information, which is vehicle information (a distance to the vicinity of the intersection center node 316 and the speed) detected by a sensor (an image, a millimeter wave, or the like) connected to the base station device 10, and (iv) pedestrian detection information, which is information on the presence of a pedestrian in the pedestrian detection area 324 detected by the sensor connected to the base station device 10.

The derivation unit 80 determines whether or not the following support occurrence conditions are met on the basis of these pieces of information. First, the derivation unit 80 determines whether or not the following support occurrence conditions are met: (i) the host vehicle 300 exists around the intersection center node 316, (ii) the speed of the host vehicle 300 is equal to or lower than a predetermined speed, (iii) the color of a traffic signal targeted at an inflow path of the host vehicle 300 is blue, and (iv) a right winker of the host vehicle 300 is on. The derivation unit 80 determines occurrence of the right-turn collision prevention support for vehicle in a case where (v) there is oncoming another vehicle 302 and (vi) the oncoming other vehicle 302 reaches a near-side of the sensor detection area 322 (a side closer to the intersection center node 316) within a predetermined period of time under a situation in which the conditions (i) through (iv) are met. Furthermore, the derivation unit 80 determines occurrence of a right-turn collision prevention support for pedestrian in a case where a pedestrian exists in the pedestrian detection area 324 under the situation in which the conditions (i) through (iv) are met.

The predetermined period of time in (vi) is a period of time taken for the host vehicle 300 to travel from the intersection center node 316 to the right-turn end node 320 and is calculated on the basis of determined speed and acceleration. A distance from the intersection center node 316 to the right-turn end node 320 is acquired from the road shape information and the service information. In determining (vi) whether or not the oncoming other vehicle 302 reaches the near-side of the sensor detection area 322, a period of time to arrival (detection vehicle arrival period) is calculated on the basis of the distance from the near-side of the sensor detection area 322 to the other vehicle 302 and the speed of the other vehicle 302. The support is provided in a case where the following is satisfied: the detection vehicle arrival period−the predetermined period of time≤a threshold value A (sec).

(2) Right-Turn Collision Prevention Support (Inter-Vehicle Communication)

Figure 6:
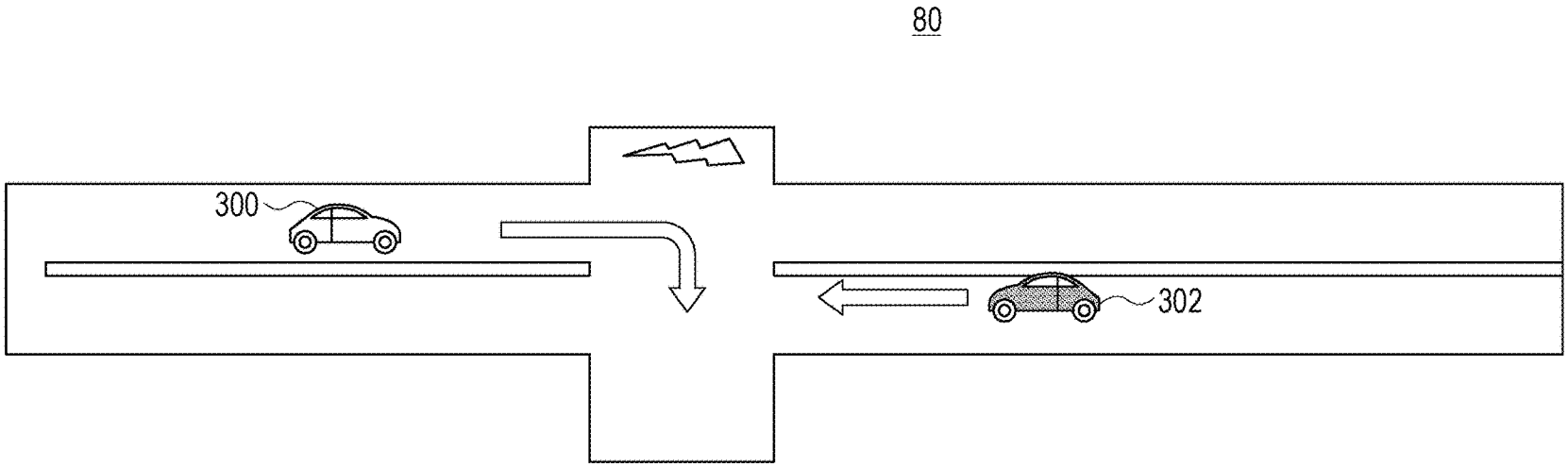
FIG. 6 is a diagram illustrating an outline of (2) a right-turn collision prevention support in the derivation unit in FIG. 4.

This support notifies a driver of the presence of an approaching vehicle (an oncoming vehicle) in a case where an oncoming vehicle is approaching when a host vehicle makes a right turn. FIG. 6 illustrates an outline of (2) the right-turn collision prevention support in the derivation unit 80. The host vehicle 300 is waiting for the start of a right turn after traveling from left to right of FIG. 5, and the other vehicle 302 is traveling from right to left of FIG. 5. In this situation, the derivation unit 80 acquires, as information from the host vehicle 300, (i) the position, speed, acceleration, and azimuth of the host vehicle 300 from a GPS or a CAN and (ii) winker information of the host vehicle 300 from the CAN or other means.

Furthermore, the derivation unit 80 acquires, as information from the other vehicle 302, the position, speed, acceleration, azimuth, and winker information of the other vehicle 302. On the basis of these pieces of information, the derivation unit 80 determines occurrence of the right-turn collision prevention support in a case where (i) the speed of the host vehicle 300 is equal to or lower than a predetermined speed, (ii) a right winker of the host vehicle 300 is on, (iii) the host vehicle 300 and the other vehicle 302 are in a positional relationship such that the host vehicle 300 and the other vehicle 302 go by each other, and (iv) the host vehicle 300 and the other vehicle 302 encounter each other within a predetermined period of time.

(3) Left-Turn Collision Prevention Support for Vehicle and/or Pedestrian (Roadside-to-Vehicle Communication)

Figure 7:
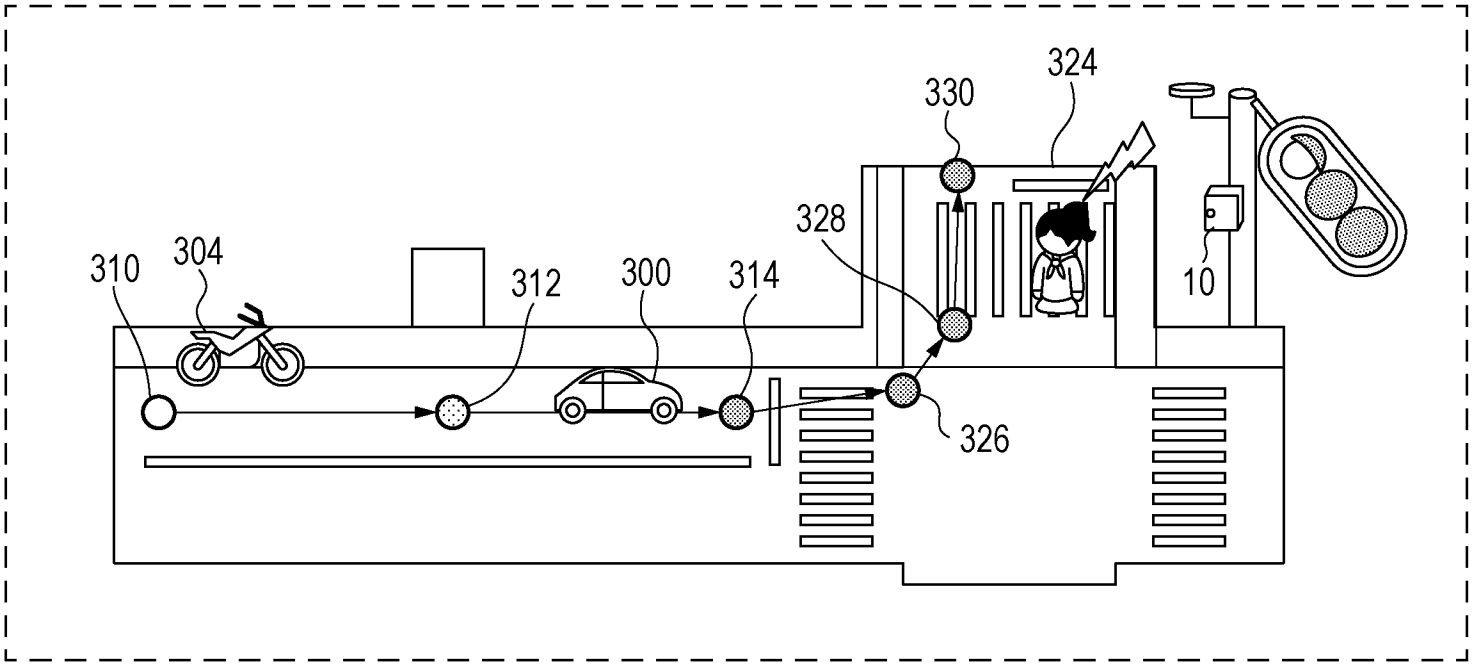
FIG. 7 is a diagram illustrating an outline of (3) a left-turn collision prevention support for vehicle and/or pedestrian in the derivation unit in FIG. 4.

This support notifies a driver of the presence of an approaching vehicle (two-wheel vehicle) in a case where a following two-wheel vehicle is approaching when a host vehicle makes a left turn or notifies the driver of the presence of a pedestrian in a case where there is a pedestrian on a crosswalk which the host vehicle making a left turn is about to cross. FIG. 7 illustrates an outline of (3) the left-turn collision prevention support for vehicle and/or pedestrian in the derivation unit 80. The base station device 10 is installed in the vicinity of the intersection. The host vehicle 300 is traveling from left to right of FIG. 7, and a two-wheel vehicle 304 is traveling behind the host vehicle 300 from left to right of FIG. 7. A start point node 310, a branch node 312, a stop line node 314, a steering start position node 326, a left-turn crosswalk node 328, and a left-turn end node 330 are defined in the travelling direction of the host vehicle 300. Furthermore, a pedestrian detection area 324 is set on the road.

The derivation unit 80 acquires, as information from the host vehicle 300, (i) the position, speed, acceleration, and azimuth of the host vehicle 300 from a GPS or a CAN and (ii) winker information of the host vehicle 300 from the CAN or other means. Furthermore, the derivation unit 80 acquires, as information from the base station device 10, (i) road shape information, which is information on the position of an intersection and a road shape, (ii) service information, which is information on a provided service and a road to which the service is provided, (iii) signal information, which is information on the current color of a traffic signal, a remaining time for which the current color is displayed, the color of the traffic light to be displayed next, and the like, (iv) vehicle detection information, which is vehicle information (a distance to the vicinity of the intersection center node 326 and the speed) detected by a sensor (an image, a millimeter wave, or the like) connected to the base station device 10, and (v) pedestrian detection information, which is information on the presence of a pedestrian in the pedestrian detection area 324 detected by the sensor connected to the base station device 10.

The derivation unit 80 determines whether or not the following support occurrence conditions are met on the basis of these pieces of information. First, the derivation unit 80 determines whether or not the following conditions are met: (i) the host vehicle 300 is approaching the intersection, (ii) the speed of the host vehicle 300 is equal to or lower than a predetermined speed, (iii) the color of a traffic signal targeted at an inflow path of the host vehicle 300 is blue or a left-turn arrow, and (iv) a left winker of the host vehicle 300 is on. The derivation unit 80 determines occurrence of the left-turn collision prevention support for vehicle in a case where the following two-wheel vehicle 304 reaches the steering start position node 326 within a period of time a from a timing at which the host vehicle 300 reaches the steering start position node 326 under a situation in which the conditions (i) through (iv) are met. Furthermore, the derivation unit 80 determines occurrence of the left-turn collision prevention support for pedestrian in a case where a pedestrian exists in the pedestrian detection area 324 under the situation in which the conditions (i) through (iv) are met.

(4) Left-Turn Collision Prevention Support (Inter-Vehicle Communication)

Figure 8:
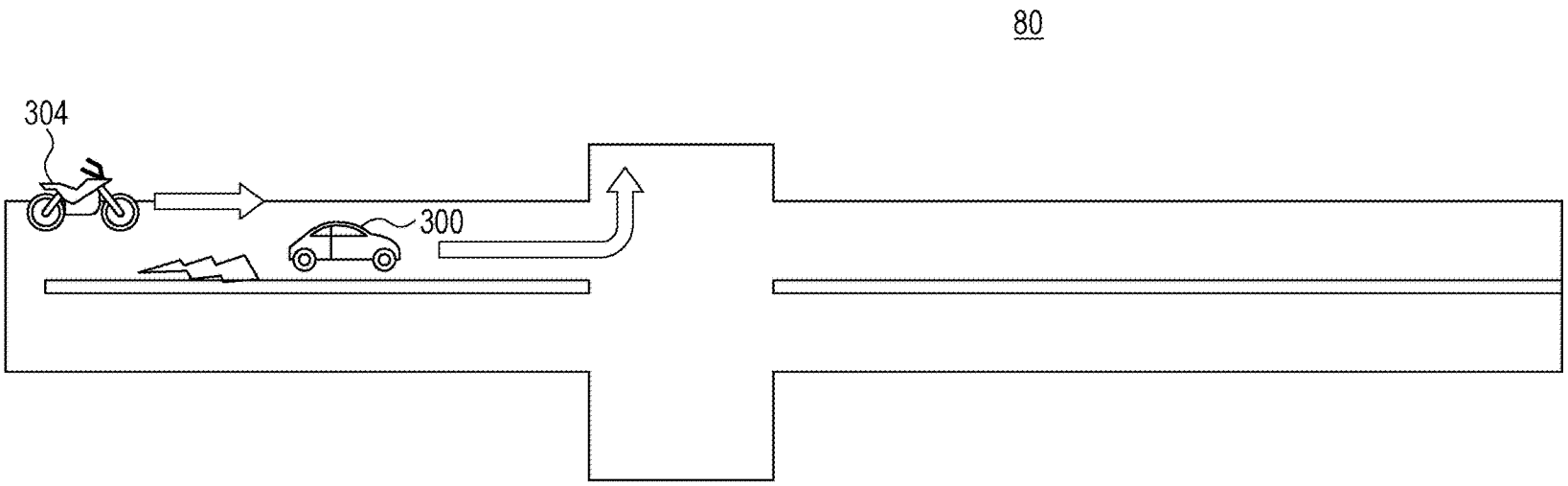
FIG. 8 is a diagram illustrating an outline of (4) a left-turn collision prevention support in the derivation unit in FIG. 4.

This supports notifies a driver of the presence of an approaching vehicle (two-wheel vehicle) in a case where a following two-wheel vehicle is approaching when a host vehicle makes a left turn. FIG. 8 illustrates an outline of (4) the left-turn collision prevention support in the derivation unit 80. The host vehicle 300 is traveling from left to right of FIG. 8, and the two-wheel vehicle 304 is traveling behind the host vehicle 300 from left to right of FIG. 8. In this situation, the derivation unit 80 acquires, as information from the host vehicle 300, (i) the position, speed, acceleration, and azimuth of the host vehicle 300 from a GPS or a CAN and (ii) winker information of the host vehicle 300 from the CAN or other means.

Furthermore, the derivation unit 80 acquires, as information from the two-wheel vehicle 304, (i) the position, speed, acceleration, azimuth, and winker information of the two-wheel vehicle 304 and (ii) identification information indicative of a two-wheel vehicle. On the basis of these pieces of information, the derivation unit 80 determines occurrence of the left-turn collision prevention support in a case where (i) the speed of the host vehicle 300 is equal to or lower than a predetermined speed, (ii) a left winker of the host vehicle 300 is on, (iii) the other vehicle is the two-wheel vehicle 304, (iv) the two-wheel vehicle 304 is traveling behind the host vehicle 300, and (iv) the host vehicle 300 and the two-wheel vehicle 304 encounter within a predetermined period of time.

(5) Crossing Collision Prevention Support (Inter-Vehicle Communication)

Figure 9:
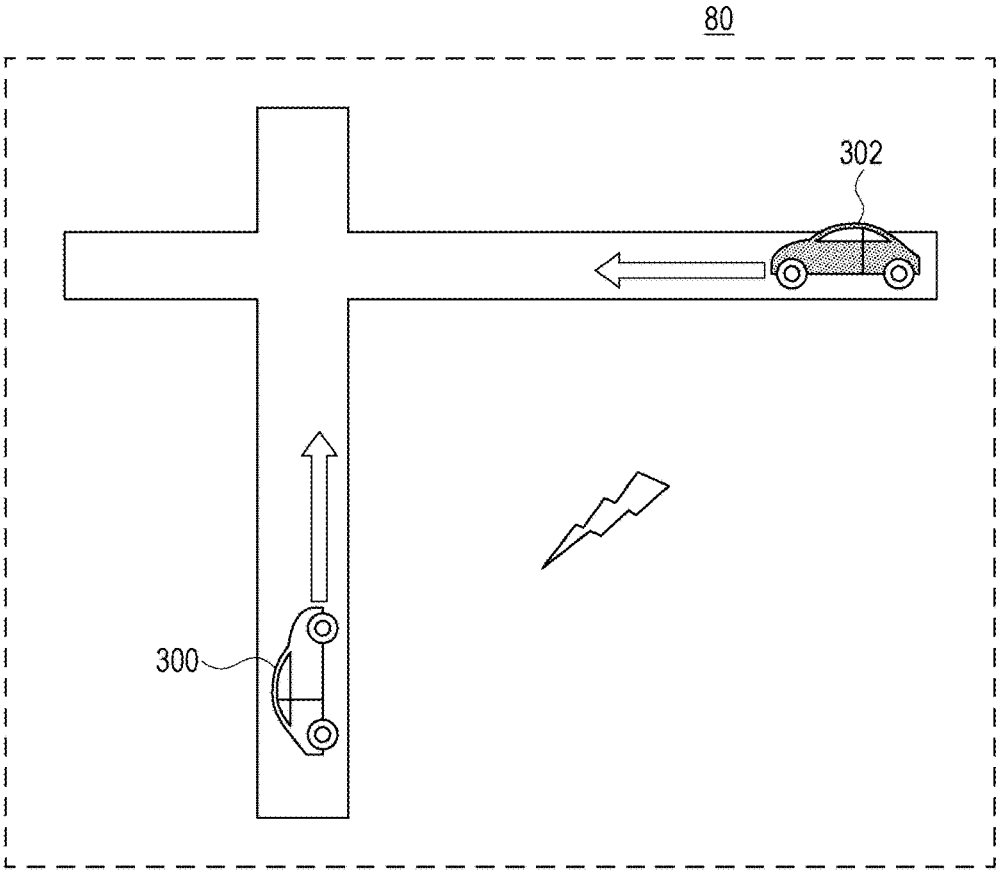
FIG. 9 is a diagram illustrating an outline of (5) a crossing collision prevention support in the derivation unit in FIG. 4.

This support notifies a driver of the presence of an approaching vehicle in a case where another vehicle is approaching so as to cross a road on which a host vehicle is traveling straight. FIG. 9 illustrates an outline of (5) the crossing collision prevention support in the derivation unit 80. The host vehicle 300 is traveling from bottom to top of FIG. 9, and another vehicle 302 is traveling from right to left of FIG. 9. In this situation, the derivation unit 80 acquires, as information from the host vehicle 300, the position, speed, acceleration, and azimuth of the host vehicle 300 from a GPS or a CAN.

Furthermore, the derivation unit 80 acquires, as information from the other vehicle 302, the position, speed, acceleration, azimuth, and winker information of the other vehicle 302. On the basis of these pieces of information, the derivation unit 80 determines occurrence of the crossing collision prevention support in a case where (i) the host vehicle 300 and the other vehicle 302 are in a positional relationship such that the host vehicle 300 and the other vehicle 302 cross each other and (ii) the host vehicle 300 and the other vehicle 302 encounter each other within a predetermined period of time. Note that a condition that the speed of the host vehicle 300 is equal to or lower than a predetermined speed may be added to the conditions of occurrence of the crossing collision prevention support.

(6) Rear-End Collision Prevention Support (Inter-Vehicle Communication)

Figure 10:
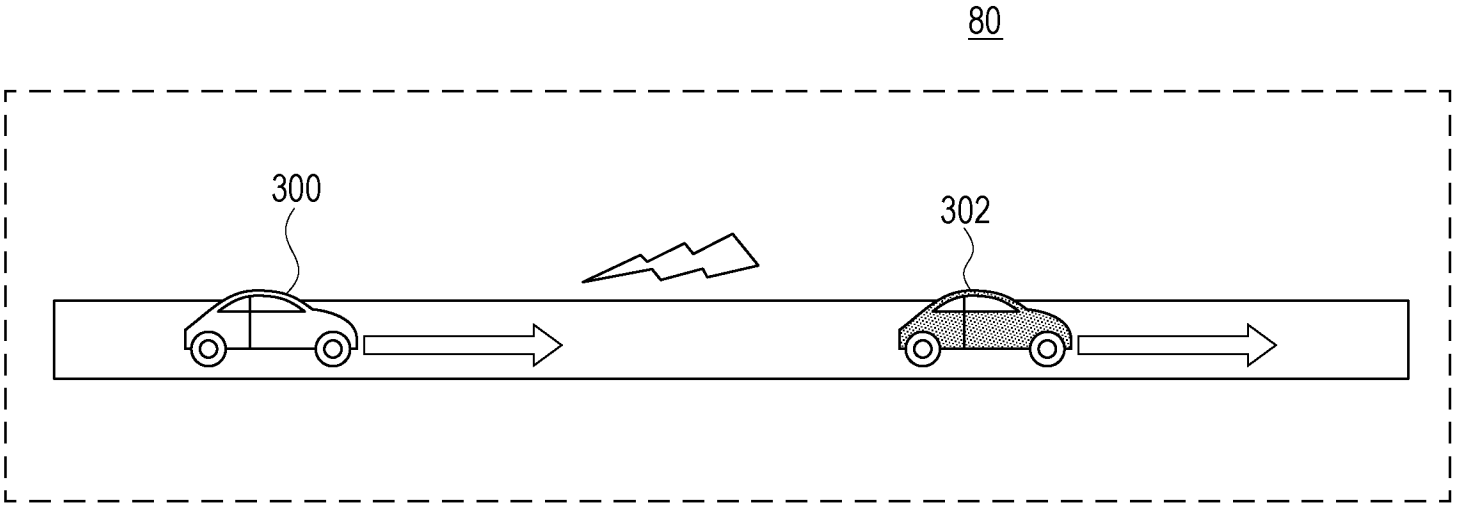
FIG. 10 is a diagram illustrating an outline of (6) a rear-end collision prevention support and an outline of (10) an emergency brake notification support in the derivation unit in FIG. 4.

This support notifies a driver of the presence of a vehicle ahead in a case where it is determined that a host vehicle is about to collide with a vehicle ahead. FIG. 10 illustrates an outline of (6) the rear-end collision prevention support and an outline of (10) the emergency brake notification support in the derivation unit 80. The host vehicle 300 is traveling from left to right of FIG. 10, and another vehicle 302 is traveling in front of the host vehicle 300 from left to right of FIG. 10. In this situation, the derivation unit 80 acquires, as information from the host vehicle 300, the position, speed, acceleration, and azimuth of the host vehicle 300 from a GPS or a CAN.

Furthermore, the derivation unit 80 acquires, as information from the other vehicle 302, the position, speed, acceleration, and azimuth of the other vehicle 302. On the basis of these pieces of information, the derivation unit 80 determines occurrence of the rear-end collision prevention support in a case where (i) the host vehicle 300 and the other vehicle 302 are in a positional relationship such that the host vehicle 300 is following the other vehicle 302, (ii) the acceleration of the host vehicle 300 is 0 or higher, and (iii) the host vehicle 300 catches up with the other vehicle 302 within a predetermined period of time.

(7) Signal Recognition Enhancement Support (Roadside-to-Vehicle Communication)

Figure 11:
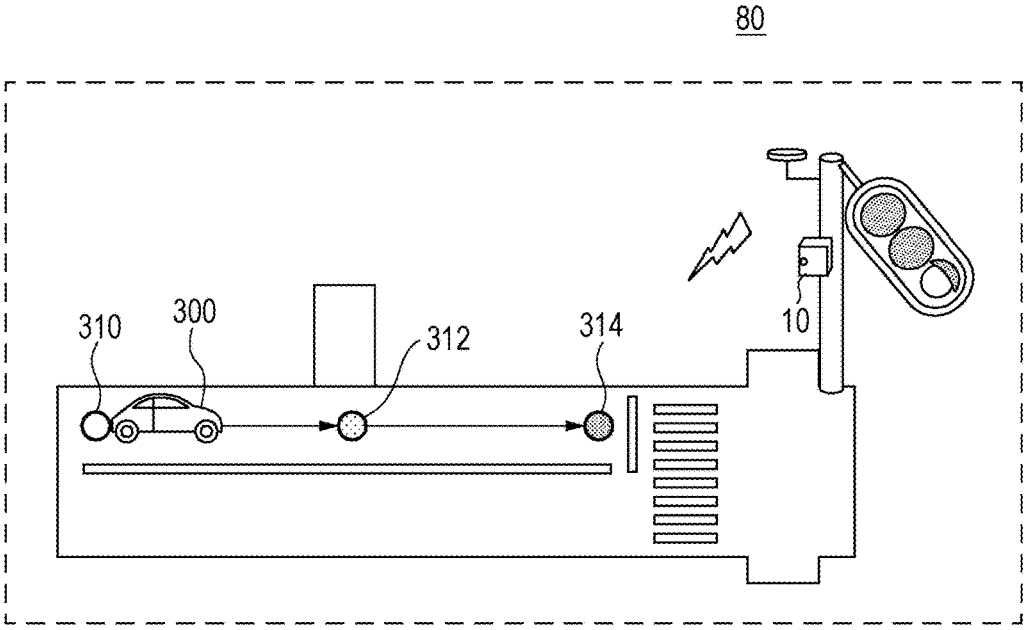
FIG. 11 is a diagram illustrating an outline of (7) signal recognition enhancement support and an outline of (11) a signal passing/signal stopping support in the derivation unit in FIG. 4.

This support notifies a driver of the presence of a traffic signal in a case where the color of a traffic signal is red when a host vehicle entering an intersection reaches a stop line of the intersection and where the host vehicle cannot safely stop at the stop line with the current speed. FIG. 11 illustrates an outline of (7) the signal recognition enhancement support and an outline of (11) the signal passing/signal stopping support in the derivation unit 80. The base station device 10 is installed in the vicinity of the intersection. The host vehicle 300 travels from left to right of FIG. 11. A start point node 310, a branch node 312, and a stop line node 314 are defined in the travelling direction of the host vehicle 300.

The derivation unit 80 acquires, as information from the host vehicle 300, the position, speed, acceleration, and azimuth of the host vehicle 300 from a GPS or a CAN. Furthermore, the derivation unit 80 acquires, as information from the base station device 10, (i) road shape information, which is information on the position of an intersection and a road shape, (ii) service information, which is information on a provided service and a road to which the service is provided, (iii) signal information, which is information on the current color of a traffic signal, a remaining time for which the current color is displayed, the color of the traffic light to be displayed next, and the like.

On the basis of these pieces of information, the derivation unit 80 determines occurrence of the signal recognition enhancement support in a case where (i) the color of the traffic signal after elapse of a period of time Tsec, which is a period of time taken for the host vehicle 300 to reach the stop line node 314 assuming that the host vehicle 300 travels while keeping the current speed, is red and therefore the host vehicle 300 cannot enter the intersection and (ii) a distance needed for the host vehicle 300 to safely stop with the current speed exceeds a distance from the position of the host vehicle 300 to the stop line node 314.

(8) Emergency Vehicle Approaching Support (Roadside-to-Vehicle Communication and Inter-Vehicle Communication)

Figure 12:
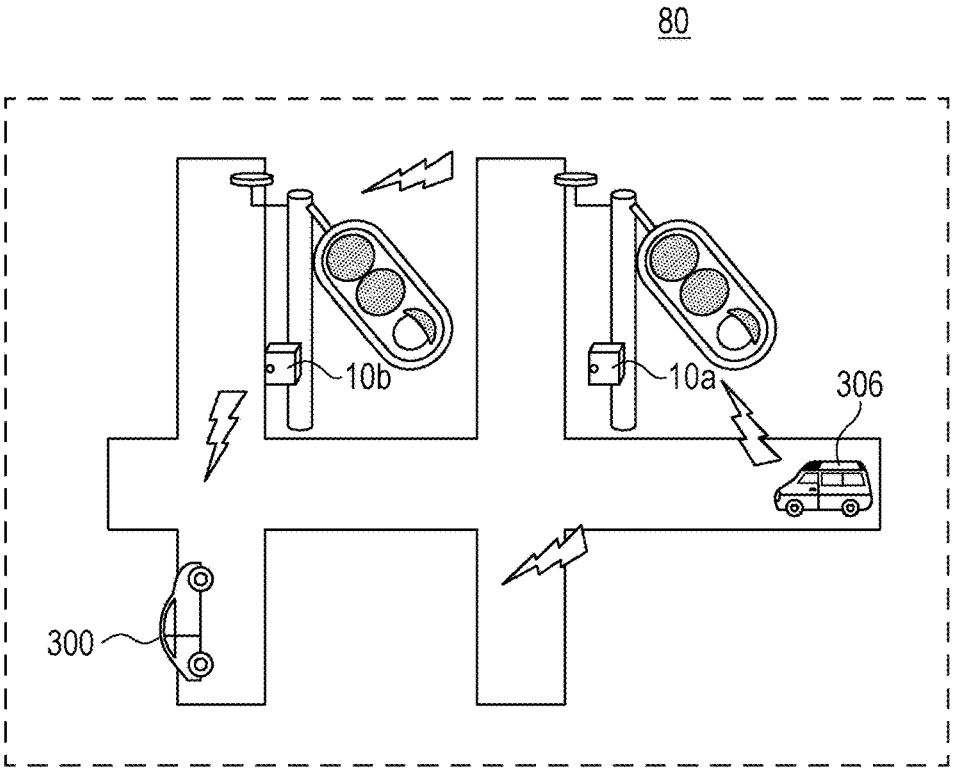
FIG. 12 is a diagram illustrating an outline of (8) an emergency vehicle approaching support in the derivation unit in FIG. 4.

This support notifies a driver of emergency vehicle approaching information in a case where a host vehicle receives emergency vehicle approaching information from an emergency vehicle or a roadside device. FIG. 12 illustrates an outline of (8) the emergency vehicle approaching support in the derivation unit 80. A first base station device 10*a* and a second base station device 10*b* are installed as the base station device 10 in the vicinity of respective two intersections. The host vehicle 300 is traveling from bottom to top of FIG. 12, and an emergency vehicle 306 is traveling from right to left of FIG. 12.

The derivation unit 80 acquires, as information from the host vehicle 300, the position, speed, acceleration, and azimuth of the host vehicle 300 from a GPS or a CAN. Furthermore, the derivation unit 80 acquires, as information from the emergency vehicle 306, the position, speed, acceleration, and azimuth of the emergency vehicle 306. Furthermore, the derivation unit 80 acquires, as information from the base station device 10, emergency vehicle approaching information, which is information transmitted from the emergency vehicle 306. Alternatively, the derivation unit 80 may acquire, as emergency vehicle approaching information, the position, speed, and azimuth of the emergency vehicle 306 and classification (identification information) indicating that a transmission source is an emergency vehicle directly from the emergency vehicle 306 via inter-vehicle communication.

Upon receipt of the emergency vehicle approaching information, the derivation unit 80 provides the information to the driver of the host vehicle 300. Furthermore, the derivation unit 80 alerts the driver of the host vehicle 300 in a case where it is determined that the host vehicle 300 and the emergency vehicle 306 are in the following positional relationship and encounter within a predetermined period of time on the basis of the position, speed, and azimuth of the host vehicle 300 and the position, speed, and azimuth of the emergency vehicle 306 included in the emergency vehicle approaching information. The positional relationship is a relationship such that the traveling direction of the host vehicle 300 and the traveling direction of the emergency vehicle 306 cross each other, the host vehicle 300 and the emergency vehicle 306 go by each other, or the emergency vehicle 306 overtakes the host vehicle 300. Providing the information and alerting the driver correspond to the emergency vehicle approaching support.

(9) Surrounding Event Notification Support (Inter-Vehicle Communication)

Figure 13:
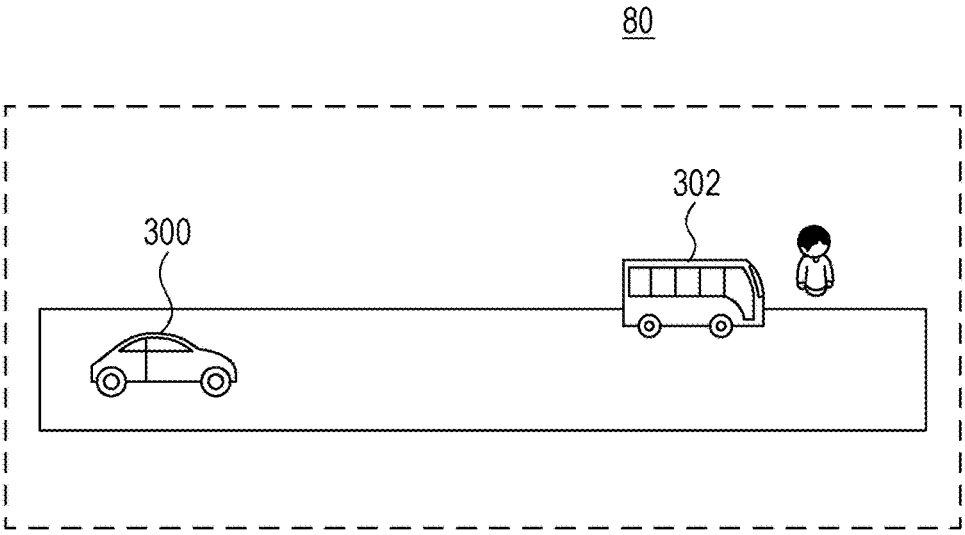
FIG. 13 is a diagram illustrating an outline of (9) a surrounding event notification support in the derivation unit in FIG. 4.

This support notifies a driver of an event that occurs on a path on which a host vehicle is traveling. FIG. 13 illustrates an outline of (9) the surrounding event notification support in the derivation unit 80. The host vehicle 300 travels from left to right of FIG. 13. Another vehicle 302 exists on the path of the host vehicle 300. In this situation, the derivation unit 80 acquires, as information from the host vehicle 300, the position, speed, acceleration, and azimuth of the host vehicle 300 from a GPS or a CAN.

Furthermore, the derivation unit 80 acquires, as information from the other vehicle 302, (i) the position, speed, acceleration, and azimuth of the other vehicle 302, (ii) vehicle usage classification of the other vehicle 302, which is set in accordance with the vehicle at device setup, and (iii) state information of the other vehicle 302, which is set in accordance with the state by a driver. The (iii) state information include information such as "getting on or out" or "working while parking" and may be automatically set in accordance with a door opening closing state. On the basis of these pieces of information, the derivation unit 80 determines occurrence of the surrounding event notification support in a case where (i) the host vehicle 300 and the other vehicle 302 are in a positional relationship such that the host vehicle 300 and the other vehicle 302 go by each other or the host vehicle 300 overtakes the other vehicle 302, (ii) the host vehicle 300 and the other vehicle 302 encounter each other within a predetermined period of time, and (iii) the other vehicle 302 meets any of Condition 1 that the other vehicle 302 is a private vehicle and a person is getting on or out, Condition 2 that the other vehicle 302 is a passenger vehicle and a person is getting on or off, and Condition 3 that the other vehicle 302 is a road work vehicle and is working while parking, working at a low speed, coping with an accident, or being stuck in a traffic jam. Note that the information from the other vehicle 302 may be direct information such as stopping and parking vehicle information, construction information, accident information, and traffic jam information on a traveling path acquired by the other vehicle that is traveling ahead the host vehicle 300.

(10) Emergency Brake Notification Support (Inter-Vehicle Communication)

This support notifies a driver of emergency brake information in a case where a driver of a vehicle in front of a host vehicle has suddenly braked. FIG. 10 illustrates an outline of (6) the rear-end collision prevention support and an outline of (10) the emergency brake notification support in the derivation unit 80. FIG. 10 has been described above, and description thereof is omitted. The derivation unit 80 acquires, as information from the host vehicle 300, the position, speed, acceleration, and azimuth of the host vehicle 300 from a GPS or a CAN.

Furthermore, the derivation unit 80 acquires, as information from the other vehicle 302, the position, speed, acceleration, and azimuth of the other vehicle 302. On the basis of these pieces of information, the derivation unit 80 determines occurrence of the emergency brake notification support in a case where (i) the host vehicle 300 and the other vehicle 302 are in a positional relationship such that the host vehicle 300 is following the other vehicle 302, (ii) a distance between the host vehicle 300 and the other vehicle 302 is within a predetermined distance, and (iii) the driver of the other vehicle 302 suddenly brakes. Note that (iii) the case where the driver of the other vehicle 302 suddenly brakes corresponds to a case where deceleration of the other vehicle 302, which is acceleration information, is equal to or higher than a predetermined value. Alternatively, the derivation unit 80 may additionally acquire, as the information from the other vehicle 302, brake operation information (especially emergency brake information) of the other vehicle 302 and determine whether or not the driver of the other vehicle 302 has suddenly braked on the basis of the brake operation information.

(11) Signal Passing/Signal Stopping Support (Roadside-to-Vehicle Communication)

This support recommends a driver to slow down by releasing an accelerator in a case where it is predicted that a traffic signal turns red when a host vehicle entering an intersection reaches a stop line of the intersection. FIG. 11 illustrates an outline of (7) the signal recognition enhancement support and an outline of (11) the signal passing/signal stopping support in the derivation unit 80. FIG. 11 has been described above, and description thereof is omitted. The derivation unit 80 acquires, as information from the host vehicle 300, the position, speed, acceleration, and azimuth of the host vehicle 300 from a GPS or a CAN.

The derivation unit 80 acquires, as information from the base station device 10, (i) road shape information, which is information on the position of an intersection and a road shape, (ii) service information, which is information on a provided service and a road to which the service is provided, (iii) signal information, which is information on the current color of a traffic signal, a remaining time for which the current color is displayed, the color of the traffic light to be displayed next, and the like. On the basis of these pieces of information, the derivation unit 80 determines occurrence of the signal passing/signal stopping support in a case where (i) the color of the traffic signal after elapse of a period of time Tsec, which is a period of time taken for the host vehicle 300 to reach the stop line node 314 assuming that the host vehicle 300 travels while keeping the current speed, is red and therefore the host vehicle 300 cannot enter the intersection.

(12) Idling Stop Support (Roadside-to-Vehicle Communication)

Figure 14:
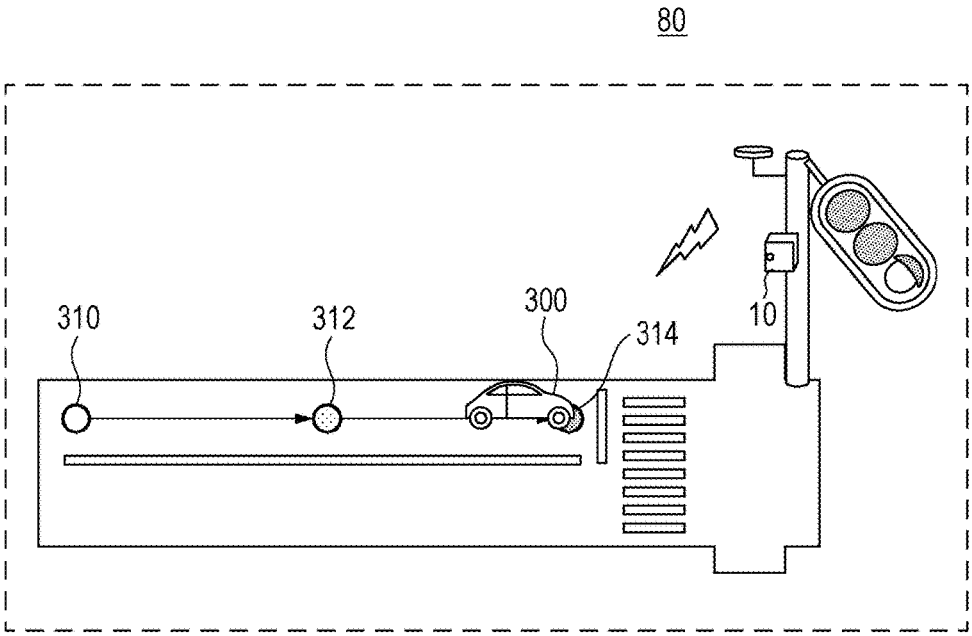
FIG. 14 is a diagram illustrating an outline of (12) an idling stop support and an outline of (13) a signal change starting support in the derivation unit in FIG. 4.

This support recommends a driver not to stop idling in a case where a host vehicle is stopping at an intersection because of a red traffic signal and where a period of time taken for the traffic signal to turn blue is less than a predetermined period of time. FIG. 14 illustrates an outline of (12) the idling stop support and an outline of (13) the signal change starting support in the derivation unit 80. The base station device 10 is installed in the vicinity of the intersection. The host vehicle 300 stops at a stop line node 314. A start point node 310, a branch node 312, and the stop line node 314 are defined in the traveling direction of the host vehicle 300.

The derivation unit 80 acquires, as information from the host vehicle 300, the position, speed, acceleration, and azimuth of the host vehicle 300 from a GPS or a CAN. Furthermore, the derivation unit 80 acquires, as information from the base station device 10, (i) road shape information, which is information on the position of an intersection and a road shape, (ii) service information, which is information on a provided service and a road to which the service is provided, (iii) signal information, which is information on the current color of a traffic signal, a remaining time for which the current color is displayed, the color of the traffic light to be displayed next, and the like.

On the basis of these pieces of information, the derivation unit 80 determines occurrence of the idling stop support in a case where (i) the host vehicle 300 is stopping at the stop line node 314 and (ii) a current color of a traffic signal in front of the host vehicle 300 is red and a period of time taken for the traffic signal to turn blue is less than a predetermined period of time. Note that in a case where the period of time taken for the traffic signal to turn blue is equal to or longer than the predetermined period of time, the derivation unit 80 may prompt the driver to stop idling. In a case where the host vehicle 300 is a vehicle that automatically stops idling, idling stop is automatically controlled in accordance with a period of time taken for the traffic signal to change from red to blue. In a case where the host vehicle 300 is a vehicle that automatically stops idling, the condition (i) is changed to "a case where a distance from the host vehicle 300 to the stop line node 314 is equal to or shorter than a predetermined distance and the speed is equal to or lower than a predetermined speed" since idling is stopped at the predetermined speed or lower.

(13) Signal Change Starting Support (Roadside-to-Vehicle Communication)

This support prompts a driver to prepare for starting a vehicle in a case where a host vehicle is stopping at an intersection and a period of time taken for the color of a traffic signal to change from red to blue is less than a predetermined period of time. FIG. 14 illustrates an outline of (12) the idling stop support and an outline of (13) the signal change starting support in the derivation unit 80. FIG. 14 has been described above, and description thereof is omitted. The derivation unit 80 acquires, as information from the host vehicle 300, the position, speed, acceleration, and azimuth of the host vehicle 300 from a GPS or a CAN.

Furthermore, the derivation unit 80 acquires, as information from the base station device 10, (i) road shape information, which is information on the position of an intersection and a road shape, (ii) service information, which is information on a provided service and a road to which the service is provided, (iii) signal information, which is information on the current color of a traffic signal, a remaining time for which the current color is displayed, the color of the traffic light to be displayed next, and the like. On the basis of these pieces of information, the derivation unit 80 determines occurrence of the signal change starting support in a case where (i) the host vehicle 300 is stopping at the stop line node 314 and (ii) a current color of a traffic signal in front of the host vehicle 300 is red, and a period of time taken for the traffic signal to turn blue is less than a predetermined period of time.

(14) Moderate Acceleration Support (Roadside-to-Vehicle Communication)

Figure 15:
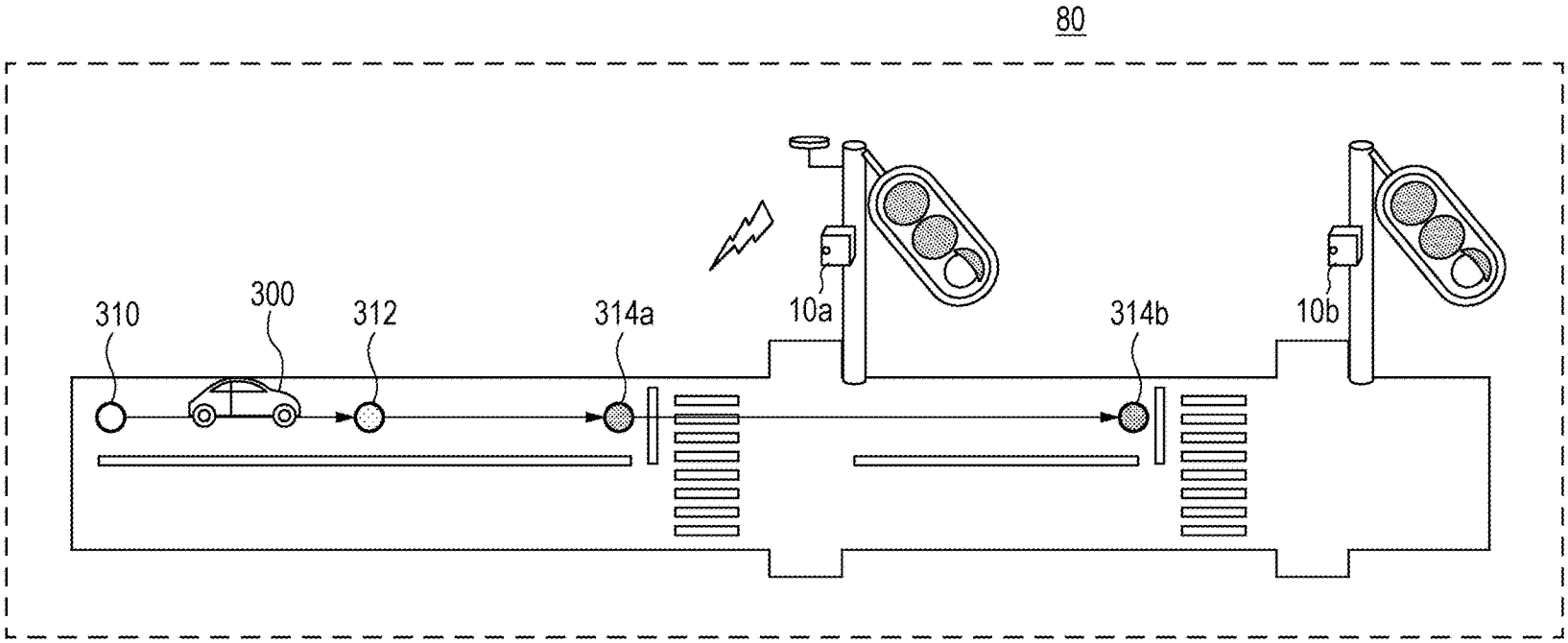
FIG. 15 is a diagram illustrating an outline of (14) a moderate acceleration support in the derivation unit in FIG. 4.

This support recommends a driver to suppress acceleration in a case where when a host vehicle starts moving from an intersection, it is predicted that the color of a traffic signal is red when the host vehicle reaches a next intersection. FIG. 15 illustrates an outline of (14) the moderate acceleration support in the derivation unit 80. A first base station device 10*a* and a second base station device 10*b* are installed as the base station device 10 in the vicinity of respective two intersections. The host vehicle 300 travels from left to right of FIG. 15. A start point node 310, a branch node 312, a first stop line node 314*a*, and a second stop line node 314*b* are defined in the traveling direction of the host vehicle 300. The start point node 310, the branch node 312, and the first stop line node 314*a* are set in the first base station device 10*a*, and the second stop line node 314*b* is set in the second base station device 10*b*.

The derivation unit 80 acquires, as information from the host vehicle 300, the position, speed, acceleration, and azimuth of the host vehicle 300 from a GPS or a CAN. Furthermore, the derivation unit 80 acquires, as information from the base station devices 10 (the first base station device 10*a* and the second base station device 10*b*), (*i*) road shape information, which is information on the position of an intersection and a road shape, (ii) service information, which is information on a provided service and a road to which the service is provided, (iii) signal information, which is information on the current color of a traffic signal, a remaining time for which the current color is displayed, the color of the traffic light to be displayed next, and the like, and (iv) signal information of traveling direction, which is signal information of a signal intersection that follows a front intersection.

On the basis of these pieces of information, the derivation unit 80 determines occurrence of the moderate acceleration support in a case where (i) the host vehicle 300 starts moving from an intersection and (ii) it is predicted, on the basis of a distance to a next intersection in the traveling direction of the host vehicle 300 and the color of a next traffic light, that the color of the traffic signal in the traveling direction of the host vehicle 300 is red at a timing at which it is predicted that the host vehicle 300 reaches the next intersection. See FIG. 4 again.

The classification unit 82 classifies supports derived by the derivation unit 80 in any of a plurality of support groups that are determined in advance in accordance with degrees of risk. FIG. 16 illustrates a data structure of a table stored in the classification unit 82. In the table, four degrees of risk "1" to "4" are defined, and supports included in each degree of risk are shown. The degree of risk "1" indicates a state of the highest risk, and the degree of risk "4" indicates a state of the lowest risk. See FIG. 4 again. The classification unit 82 determines the degree of risk of each support derived by the derivation unit 80 by referring to the table.

The selection unit 84 selects one support group classified by the classification unit 82. In this example, the selection unit 84 selects a support group with the highest degree of risk in which a support derived by the derivation unit 80 is included. For example, in a case where a support derived by the derivation unit 80 is included in the support group with the degree of risk "1", the selection unit 84 selects the support group with the degree of risk "1". Meanwhile, in a case where a support derived by the derivation unit 80 is not included in the support group with the degree of risk "1" and where a support derived by the derivation unit 80 is included in the support group with the degree of risk "2", the selection unit 84 selects the support group with the degree of risk "2". In a case where a support derived by the derivation unit 80 is not included in the support groups with the degrees of risk "1", "2", and "3" and where a support derived by the derivation unit 80 is included in the support group with the degree of risk "4", the selection unit 84 selects the support group with the degree of risk "4".

Next, the selection unit 84 acquires, for each of a plurality of supports included in the selected support group, a period of time to collision (TTC: Time-To-Collision), which is a period of time to occurrence of an event. The selection unit 84 selects two or more supports for which an event occurs within a predetermined period of time from the shortest TTC. The selection unit 84 notifies the priority determination unit 86 of information on the selected two or more supports.

The priority determination unit 86 determines a priority of each of the two or more supports selected by the selection unit 84 in accordance with a support situation irrespective of a TTC. The support situation is determined as a priority based on situation. The priority based on situation is determined by using mainly information on a vehicle type of a host vehicle, vehicle types of other vehicles (including a pedestrian), and information on a past accident log at a point of event. Alternatively, the priority based on situation may be determined by using information including the state of the other vehicle and the state of the driver of the other vehicle. Alternatively, the priority based on situation may be determined by using information including the state of the driver of the host vehicle. FIG. 17 illustrates a data structure of a table stored in the priority determination unit 86. As illustrated in FIG. 17, the contents of a situation are shown for each of a plurality of items. The priority determination unit 86 selects items which the support applies by referring to the table. Furthermore, the priority determination unit 86 derives a priority by calculating the following evaluation function using the selected items:

priority=coefficient 1*item 1+coefficient 2*item 2+ . . .

In the above evaluation function, an item such as the item 1 becomes "1" in a case where the support applies this item and becomes "0" in a case where the support does not apply to this item. Furthermore, the item becomes "0" in a case where information concerning the item cannot be acquired. The priority of support occurrence becomes higher as the value of the priority thus derived becomes larger. This priority corresponds to the order of the support provided to the driver.

The priority determination unit 86 supplies plural combinations of support and priority to the display unit 70. The support determination unit 68 derives a plurality of supports that can be provided to a driver of the vehicle 12 in which the present terminal device 14 is mounted on the basis of the information acquired by the acquisition unit 64 and the information acquired by the extraction unit 72.

Figure 18:
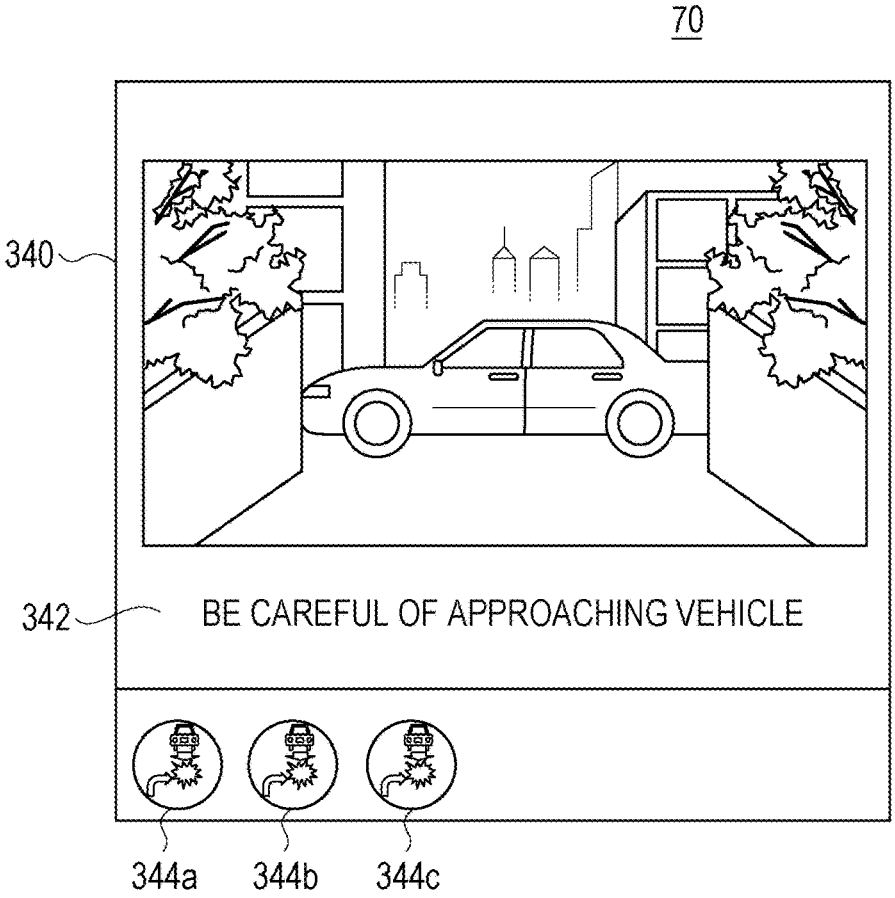
FIG. 18 is a diagram illustrating a screen displayed on a display unit in FIG. 4.

The display unit 70 displays the two or more supports on a monitor (not illustrated) at different levels of display details in accordance with the priorities determined by the priority determination unit 86. That is, the display unit 70 displays a support with the highest priority in a large scale and displays a support with a lower priority as an icon 344. Display examples on the display unit 70 are described below. FIG. 18 is a view illustrating a screen displayed on the display unit 70. A display area for highest priority 342 and one or more icons 344 are displayed in a display area for alert image 340. The display area for alert image 340 may be displayed as a pop-up or a split-screen of a car navigation system.

The display area for highest priority 342 is disposed in an upper part of the display area for alert image 340, and the contents of a support given the highest priority by the priority determination unit 86 are displayed in the display area for highest priority 342. In this example, a message concerning the crossing collision prevention support is displayed. The one or more icons 344 are displayed in a lower part of the display area for highest priority 342. In this example, a first icon 344*a*, a second icon 344*b*, and a third icon 344*c* are arranged side by side in a horizontal direction. Each of the icons 344 represents the contents of a support. In this example, each of the icons 344 represents the contents of the right-turn collision prevention support. In a case where a plurality of icons 344 are displayed, an icon 344 with a higher priority is disposed on the left side. That is, a support with the highest priority is displayed in the display area for highest priority 342, and supports with lower priorities are displayed simply as icons 344. In this way, supports that can occur in the future (supports that can be provided subsequently to the support with the highest priority) are displayed as the icons 344.

Figure 19:
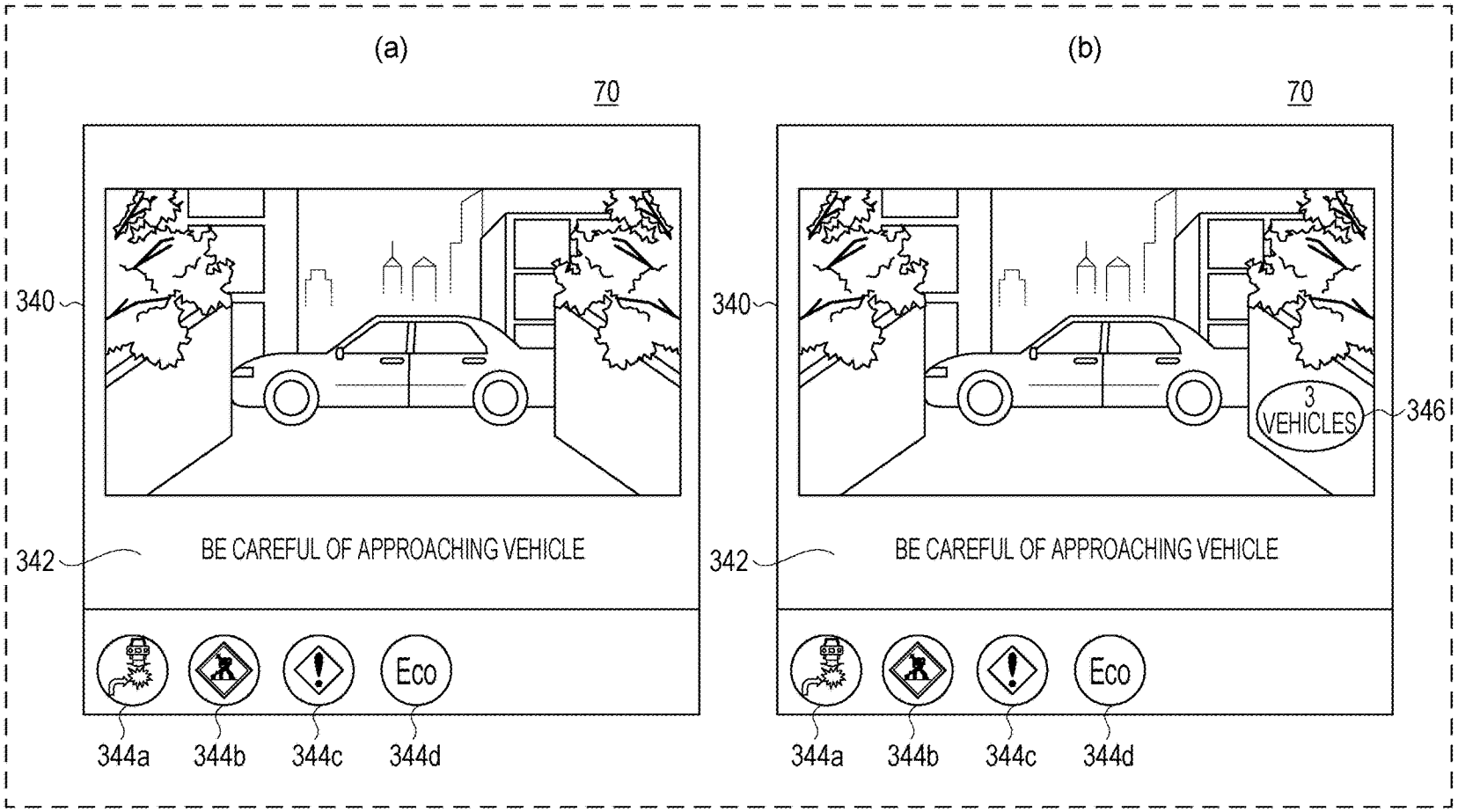
FIG. 19 is a diagram illustrating other screens displayed on the display unit in FIG. 4.

In the above description, the priority determination unit 86 determines priorities of two or more supports included in a single support group selected by the selection unit 84. However, supports included in a support group that has not been selected by the selection unit 84 may also be given priorities and derived as supports that can be provided to a driver by similar processing in the selection unit 84 and the priority determination unit 86. In this case, it is only necessary that the supports included in the support group with a lower degree of risk be given priorities lower than those of the supports included in the support group with a higher degree of risk. FIG. 19 illustrates other screens displayed on the display unit 70. On the screens illustrated in FIG. 19, supports included in two or more support groups are displayed. The screen illustrated in FIG. 19(*a*) is a screen similar to that illustrated in FIG. 18 but is different from that illustrated in FIG. 18 in a plurality of icons 344 displayed in the lower part of the display area for highest priority 342. In this example, a first icon 344*a*, a second icon 344*b*, a third icon 344*c*, and a fourth icon 344*d* are arranged side by side in a horizontal direction. The first icon 344*a* represents the right-turn collision prevention support, and the second icon 344*b* and the third icon 344*c* represent the surrounding event notification support, and the fourth icon 344*d* represents the idling stop support.

FIG. 19(*b*) illustrates a screen displayed in a case where there are a plurality of other vehicles 302 at which a single support is targeted under the same situation as that of FIG. 19(*a*). As described above, the contents of a support with the highest priority is illustrated in the display area for highest priority 342. In this example, there are a plurality of other vehicles 302 at which a single support is targeted. For example, in a case where there are three successive other vehicles 302 which the crossing collision prevention support is targeted at, a driver is also notified of approach of the three other vehicles 302 in a display area for the number of target vehicles 346. Note that an image suggesting that there are a plurality of other vehicles 302 may be displayed instead of the number of target vehicles.

Figure 20:
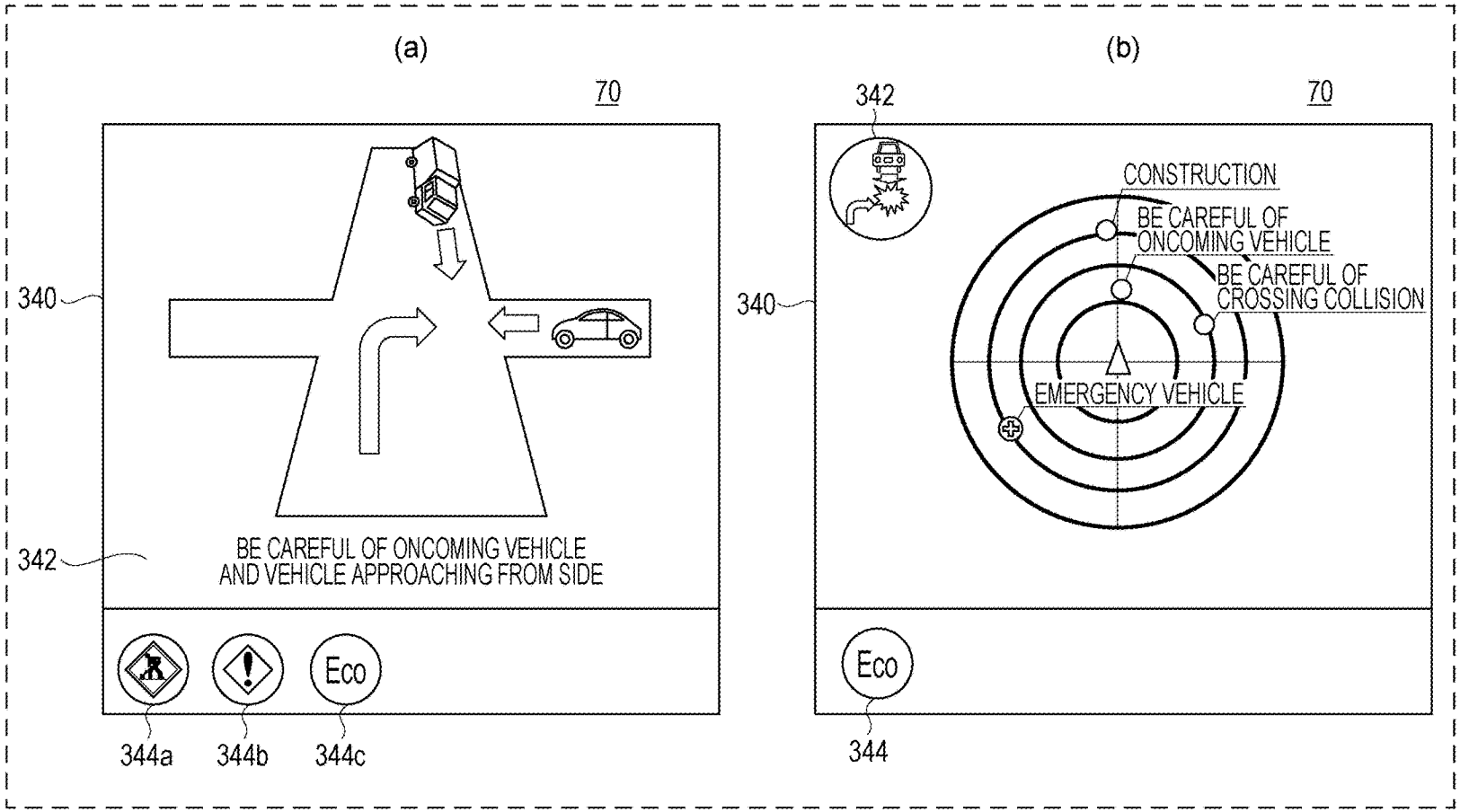
FIG. 20 is a diagram illustrating still other screens displayed on the display unit in FIG. 4.

FIG. 20 illustrates still other screens displayed on the display unit 70. FIG. 20(*a*) also illustrates a screen displayed in a case where a plurality of supports are occurring concurrently. In this example, supports with the same degree of risk and whose TTCs are close to each other are concurrently displayed as an image in the display area for highest priority 342. Specifically, the right-turn collision prevention support and the crossing collision prevention support are displayed. A message corresponding to these supports is displayed below the image. Furthermore, supports with lower priorities are displayed simply as icons 344. FIG. 20(*b*) illustrates a screen displayed under a situation similar to that in FIG. 20(*a*), but a plurality of supports are concurrently displayed as a radar-like image in the display area for alert image 340. The display area for highest priority 342 is displayed in an upper left part of the display area for alert image 340, and a support with the highest priority, for example, the right-turn collision prevention support is displayed as an icon in the display area for highest priority 342. Furthermore, a support whose occurrence position does not matter (for example, the idling stop support) is displayed simply as an icon 344 in a lower left part of the display area for alert image 340.

Figure 21:
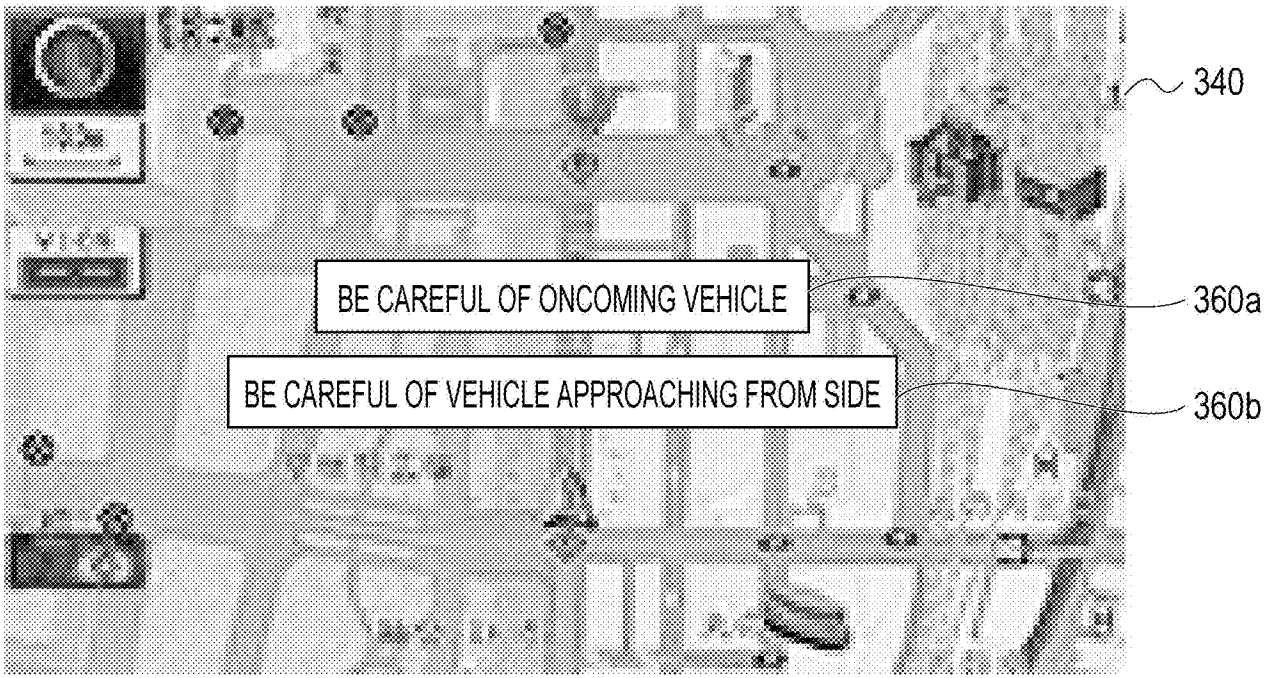
FIG. 21 is a diagram illustrating another screen displayed on the display unit in FIG. 4.

FIG. 21 illustrates still another screen displayed on the display unit 70. A map image is displayed in the display area for alert image 340, and a first message 360*a* and a second message 360*b* are displayed so as to overlap the map image. The first message 360*a* and the second message 360*b* are messages concerning supports with the same degree of risk and whose TTCs are close to each other. Note that a support with the highest priority and a support with the second highest priority may be displayed in accordance with priorities determined by the priority determination unit 86.

Figure 22:
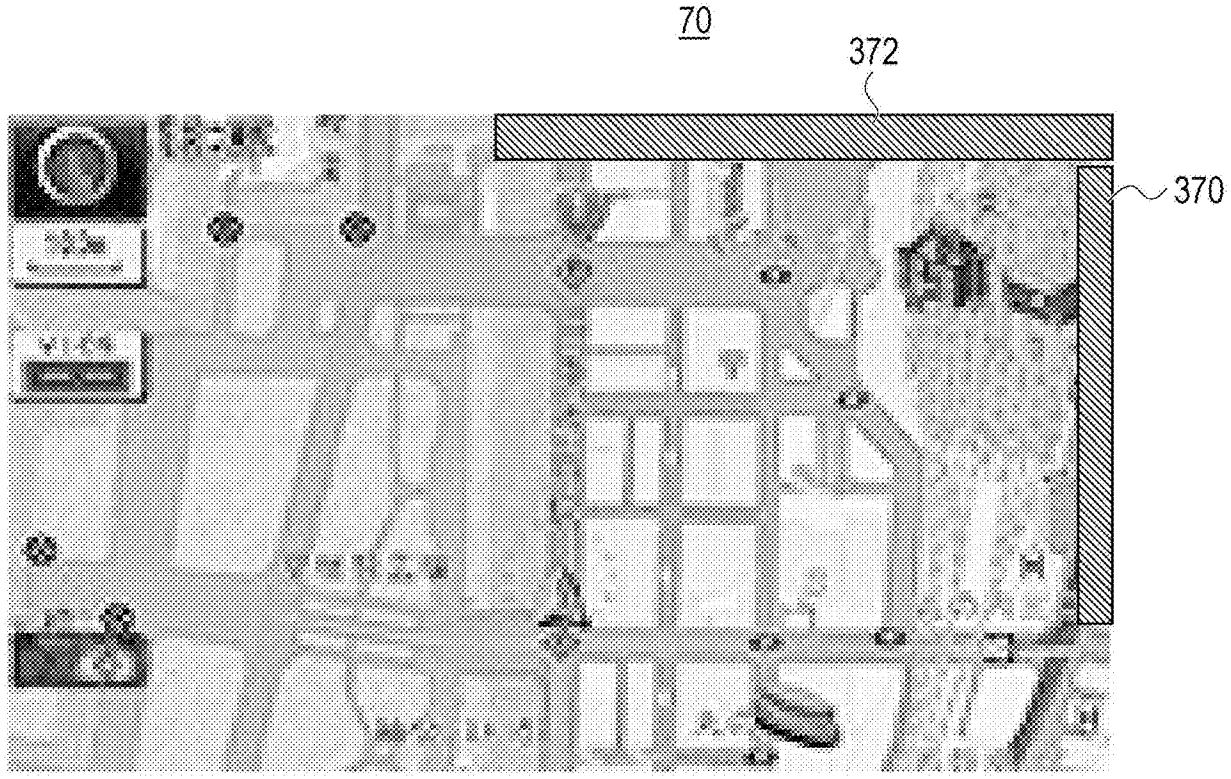
FIG. 22 is a diagram illustrating another screen displayed on the display unit in FIG. 4.

FIG. 22 illustrates still another screen displayed on the display unit 70. A map image is displayed in the display area for alert image 340. A display area for crossing collision prevention support 370 and a display area for right-turn collision prevention support 372 are displayed in a frame part of the display area for alert image 340. The crossing collision prevention support and the right-turn collision prevention support are supports with the same degree of risk and whose TTCs are close to each other. Directions in which a driver should pay attention are indicated by emphasizing parts of the frame such as the display area for crossing collision prevention support 370 and the display area for right-turn collision prevention support 372. Furthermore, the driver may be notified of the contents of the supports by voice.

Figure 23:
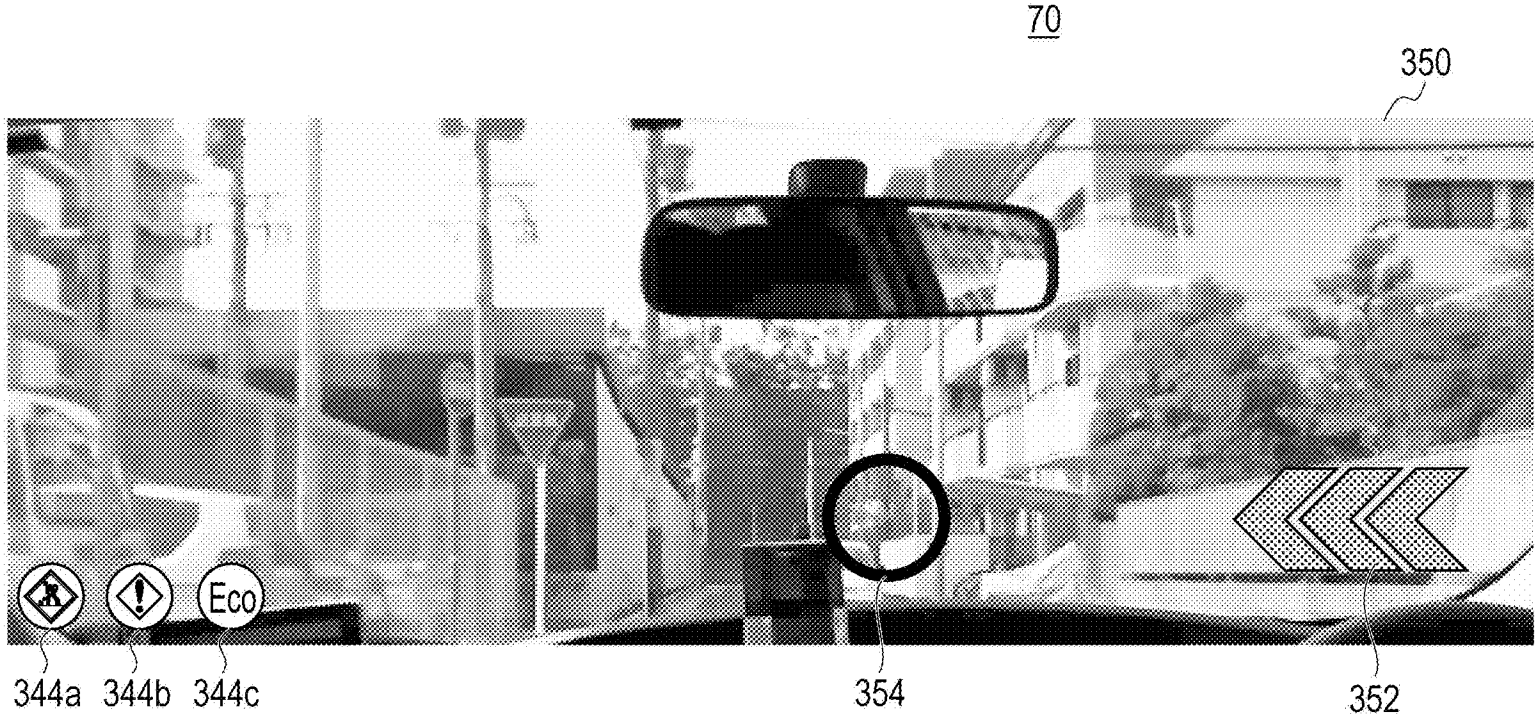
FIG. 23 is a diagram illustrating an image displayed by the display unit in FIG. 4.

FIG. 23 illustrates images displayed on the display unit 70. In this case, the display unit 70 is a HUD (Head-Up Display). A display image for crossing collision prevention support 352, a display image for right-turn collision prevention support 354, a first icon 344*a*, a second icon 344*b*, and a third icon 344*c* are displayed on a front glass 350 in accordance with supports derived by the support determination unit 68. The first icon 344*a* and the second icon 344*b* represent the surrounding event notification support, and the third icon 344*c* represents the idling stop support.

Figure 24:
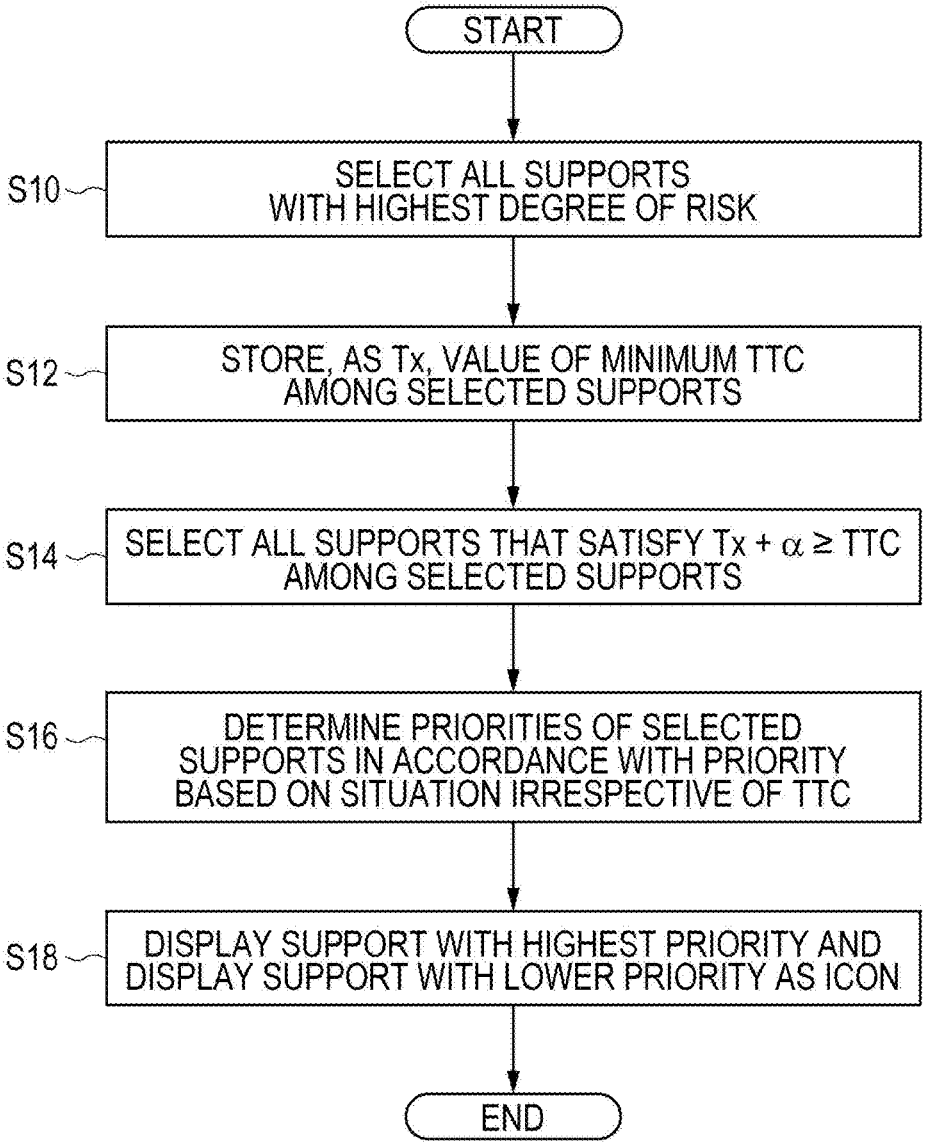
FIG. 24 is a flow chart illustrating a display procedure in a terminal device in FIG. 4.

An operation of the communication system 100 configured as above is described below. FIG. 24 is a flow chart illustrating a display procedure in the terminal device 14. The selection unit 84 selects all supports with the highest degree of risk (S10). The selection unit 84 stores, as Tx, the value of the minimum TTC among the selected supports (S12). The selection unit 84 selects all supports that satisfy $Tx+\alpha \geq TTC$ among the selected supports (S14). The priority determination unit 86 determines a priority of each of the selected supports in accordance with a priority based on situation irrespective of a TTC (S16). The display unit 70 displays a support with the highest priority and displays supports with lower priorities as icons 344 (S18).

According to the embodiment of the present disclosure, two or more supports are displayed at different levels of details in accordance with priorities of the supports. This makes it possible to notify a driver of appropriate supports even in a case where a plurality of supports occur. Since a driver is notified of appropriate supports even in a case where a plurality of supports occur, it is possible to prompt the driver to drive safely. Since priorities are determined on the basis of degrees of risk, periods of time to occurrence to events, and a situation, two or more supports appropriate for a driver can be selected and presented to the driver in accordance with the situation in which the driver is placed in a case where a plurality of supports occur. Furthermore, since a support with the highest priority is displayed in a form different from other supports, the driver can be notified of the contents of the support with the highest priority. Furthermore, since supports with lower priorities are displayed as icons, a plurality of icons can be displayed concurrently while clarifying a difference between the support with the highest priority and the supports with lower priorities. Furthermore, since a plurality of supports with the same degree of risk are given priorities in accordance with periods of time to occurrence of events and the situation, a more important support can be given a higher priority. Furthermore, since supports with lower priorities are displayed as icons, a driver can recognize the supports at an early timing as supports that can occur in the future (supports that can be provided subsequently to the support with the highest priority). Since the supports that can occur in the future are displayed, it is possible to prevent delay of driver's response to the subsequent supports.

The present disclosure has been described on the basis of the embodiment. This embodiment is an illustrative example, and it can be understood by a person skilled in the art that a combination of the constituent elements or a combination of processes can be modified in various ways and that such modifications are encompassed within the scope of the present disclosure.

One aspect of the present disclosure is summarized as follows.

(1) A first terminal device that is mountable in a first vehicle, including: an acquirer that acquires first information on the first vehicle in which the first terminal device is mounted; a receiver that receives a packet signal from a second terminal device via inter-terminal-device communication, the packet signal including second information on a second vehicle in which the second terminal device is mounted; a controller that selects a first plurality of driving supports that are capable of being provided to a driver of the first vehicle among a second plurality of driving supports, on the basis of the acquired first information and the second information included in the received packet signal, wherein the number of the second plurality of the driving supports is equal to or larger than the number of the first plurality of the driving supports; and a display that displays each of images representing each of the first plurality of the driving supports in more detail as priority given to each of the first plurality of the driving supports is higher.

According to this aspect, two or more supports can be displayed at different levels of details in accordance with priorities of the supports. Therefore, in a case where a plurality of supports occur, two or more supports appropriate for a driver can be selected and presented in accordance with a situation in which the driver is placed.

(2) In the aspect, the second information may include location information of the second vehicle, traveling direction information of the second vehicle, and speed information of the second vehicle.

(3) In the aspect, the acquirer may acquire, from a roadside device, third information on road environment on which the first vehicle is traveling, and the controller may select the first plurality of driving supports among the second plurality of driving supports, on the basis of the acquired first information, the second information and the acquired third information.

(4) In the aspect, the third information may include i) road shape information indicative of a position of an intersection within a predetermined range from the roadside device and a road shape of the intersection, ii) signal information indicative of a current color of a traffic signal within the predetermined range from the roadside device, a remaining time for which the current color is displayed, and a next color of the traffic signal to be displayed next, iii) vehicle detection information indicative of a distance from the first vehicle to a third vehicle detected by the roadside device and a speed of the detected third vehicle, iv) pedestrian detection information indicative of a presence of a pedestrian detected by the roadside device, v) service information indicative of a provided service and a road to which the service is provided, and vi) emergency vehicle approaching information transmitted from an emergency vehicle.

(5) In the aspect, the first information may include location information of the first vehicle, traveling direction information of the first vehicle, speed information of the first vehicle, and direction information indicative of a direction indicated by an indicator of the first vehicle.

(6) In the aspect, among the first plurality of driving supports, the display may display an image representing a first driving support with a higher priority in a predetermined display area and display an icon representing a second driving support with a priority lower than that of the first driving support.

In this case, since a support with a lower priority is displayed as an icon, a driver can be notified of the support that can occur in the future.

(7) In the aspect, the icon may represent a content of the second driving support.

In this case, the driver can be notified of the contents of the support by the icon.

(8) In the aspect, among the first plurality of driving supports, the display may display an image representing a first driving support with a highest priority in a predetermined display area and display icons representing second driving supports with priorities lower than that of the first driving support.

(9) In the aspect, the icons may represent contents of the second driving supports.

(10) In the aspect, the second plurality of the driving supports may include i) a right-turn collision prevention support for the second vehicle, ii) a right-turn collision prevention support for pedestrian, iii) a left-turn collision prevention support for the second vehicle, iv) a left-turn collision prevention support for pedestrian, v) a crossing collision prevention support, vi) a rear-end collision prevention support, vii) an emergency brake notification support, viii) a signal recognition enhancement support, ix) an emergency vehicle approaching notification support, x) a surrounding event notification support, xi) a signal passing support, xii) a signal stopping support, xiii) an idling stop support, xvi) a signal change starting support, and xv) a moderate acceleration support.

In this case, a plurality of supports with the same degree of risk are given priorities in accordance with periods of time to occurrence of events and a situation. Accordingly, a more important support can be given a higher priority.

(11) In the aspect, the controller may be operative to: classify the second plurality of the driving supports into a plurality of support groups in accordance with degrees of risk given to the second plurality of the driving supports; acquire periods of time-to-collision (TTC) to occurrence of events corresponding to a plurality of driving supports classified in a first support group, wherein the first support group has the highest degree of the risk; select the first plurality of the driving supports, wherein the first plurality of the driving supports correspond to events that occur within a predetermined period of time from a shortest period of time-to-collision among the acquired periods of time-to-collision; and determine priorities of the selected first plurality of driving supports on the basis of i) a vehicle type of the first vehicle, ii) a vehicle type of the second vehicles, and iii) past collision logs at occurrence points of the events corresponding to the first plurality of the driving supports.

(12) In the aspect, one of the second plurality of the driving supports may include a notification of a presence of the second vehicle to the driver of the first vehicle, in a case where it is determined that the first vehicle makes a right turn and where the second vehicle is approaching to the first vehicle.

(13) In the aspect, one of the second plurality of the driving supports may include a notification of a presence of a pedestrian to the driver of the first vehicle, in a case where it is determined that there is a pedestrian who is about to cross on a crosswalk which the first vehicle makes a right turn.

(14) In the aspect, one of the second plurality of the driving supports may include a notification of a presence of the second vehicle to the driver of the first vehicle, in a case where it is determined that the first vehicle makes a left turn and where the second vehicle is approaching to the first vehicle.

(15) In the aspect, one of the second plurality of the driving supports may include a notification of a presence of a pedestrian to the driver of the first vehicle, in a case where it is determined that there is a pedestrian who is about to cross on a crosswalk which the first vehicle makes a left turn.

(16) In the aspect, one of the second plurality of the driving supports may include a notification of a presence of the second vehicle to the driver of the first vehicle, in a case where it is determined that the second vehicle is passing over a road on which the first vehicle is traveling straight and is approaching to the first vehicle.

(17) In the aspect, one of the second plurality of the driving supports may include a notification to the driver of the first vehicle of a presence of the second vehicle ahead to the first vehicle, in a case where it is determined that the first vehicle is about to collide with the second vehicle.

What is claimed is:

1. A first terminal device that is mountable in a first vehicle, comprising:

an acquirer that acquires first information on the first vehicle in which the first terminal device is mounted;

a receiver that receives a packet signal from a second terminal device via inter-terminal-device communication, the packet signal including second information on a second vehicle in which the second terminal device is mounted;

a controller that selects a first plurality of driving supports that are capable of being provided to a driver of the first vehicle among a second plurality of driving supports, on the basis of the acquired first information and the second information included in the received packet signal, wherein the number of the second plurality of the driving supports is equal to or greater than the number of the first plurality of the driving supports, one of the first plurality of driving supports has a priority higher than another of the first plurality of driving supports; and a display including a first display area and a second display area arranged outside of the first display area, the display displaying the one of the first plurality of driving supports in the first display area, and the another of the first plurality of driving supports in the second display area, wherein an amount of information for depicting the one of the first plurality of driving supports in the first display area is greater than that for depicting the another of the first plurality of driving supports in the second display area based on the priority given to the one of the first plurality of driving supports.

2. The first terminal device according to claim 1, wherein the second information includes location information of the second vehicle, traveling direction information of the second vehicle, and speed information of the second vehicle.

3. The first terminal device according to claim 1, wherein, the acquirer acquires, from a roadside device, third information on road environment on which the first vehicle is traveling, and the controller selects the first plurality of driving supports among the second plurality of driving supports, on the basis of the acquired first information, the second information and the acquired third information.

4. The first terminal device according to claim 3, wherein the third information includes i) road shape information indicative of a position of an intersection within a predetermined range from the roadside device and a road shape of the intersection, ii) signal information indicative of a current color of a traffic signal within the predetermined range from the roadside device, a remaining time for which the current color is displayed, and a next color of the traffic signal to be displayed next, iii) vehicle detection information indicative of a distance from the first vehicle to a third vehicle detected by the roadside device and a speed of the detected third vehicle, iv) pedestrian detection information indicative of a presence of a pedestrian detected by the roadside device, v) service information indicative of a provided service and a road to which the service is provided, and vi) emergency vehicle approaching information transmitted from an emergency vehicle.

5. The first terminal device according to claim 3, wherein one of the second plurality of the driving supports includes a notification of a presence of a pedestrian to the driver of the first vehicle, in a case where it is determined that there is a pedestrian who is about to cross on a crosswalk which the first vehicle makes a right turn.

6. The first terminal device according to claim 3, wherein one of the second plurality of the driving supports includes a notification of a presence of a pedestrian to the driver of the first vehicle, in a case where it is determined that there is a pedestrian who is about to cross on a crosswalk which the first vehicle makes a left turn.

7. The first terminal device according to claim 1, wherein the first information includes location information of the first vehicle, traveling direction information of the first vehicle, speed information of the first vehicle, and direction information indicative of a direction indicated by an indicator of the first vehicle.

8. The first terminal device according to claim 1, wherein among the first plurality of driving supports, the display displays an image representing a first driving support with a higher priority in the first display area and displays an icon representing a second driving support with a priority lower than that of the first driving support in the second display area.

9. The first terminal device according to claim 8, wherein the icon represents a content of the second driving support.

10. The first terminal device according to claim 1, wherein among the first plurality of driving supports, the display displays an image representing a first driving support with a highest priority in the first display area and displays icons representing second driving supports with priorities lower than that of the first driving support in the second display area.

11. The first terminal device according to claim 10, wherein the icons represent contents of the second driving supports.

12. The first terminal device according to claim 1, wherein the second plurality of the driving supports include i) a right-turn collision prevention support for the second vehicle, ii) a right-turn collision prevention support for pedestrian, iii) a left-turn collision prevention support for the second vehicle, iv) a left-turn collision prevention support for pedestrian, v) a crossing collision prevention support, vi) a rear-end collision prevention support, vii) an emergency brake notification support, viii) a signal recognition enhancement support, ix) an emergency vehicle approaching notification support, x) a surrounding event notification support, xi) a signal passing support, xii) a signal stopping support, xiii) an idling stop support, xvi) a signal change starting support, and xv) a moderate acceleration support.

13. The first terminal device according to claim 1, wherein the controller is operative to:

classify the second plurality of the driving supports into a plurality of support groups in accordance with degrees of risk given to the second plurality of the driving supports;

acquire periods of time-to-collision (TTC) to occurrence of events corresponding to a plurality of driving supports classified in a first support group, wherein the first support group has the highest degree of the risk;

select the first plurality of the driving supports, wherein the first plurality of the driving supports correspond to events that occur within a predetermined period of time from a shortest period of time-to-collision among the acquired periods of time-to-collision; and determine priorities of the selected first plurality of driving supports on the basis of i) a vehicle type of the first vehicle, ii) a vehicle type of the second vehicles, and iii) past collision logs at occurrence points of the events corresponding to the first plurality of the driving supports.

14. The first terminal device according to claim 1, wherein one of the second plurality of the driving supports includes a notification of a presence of the second vehicle to the driver of the first vehicle, in a case where it is determined that the first vehicle makes a right turn and where the second vehicle is approaching to the first vehicle.

15. The first terminal device according to claim 1, wherein one of the second plurality of the driving supports includes a notification of a presence of the second vehicle to the driver of the first vehicle, in a case where it is determined that the first vehicle makes a left turn and where the second vehicle is approaching to the first vehicle.

16. The first terminal device according to claim 1, wherein one of the second plurality of the driving supports includes a notification of a presence of the second vehicle to the driver of the first vehicle, in a case where it is determined that the second vehicle is passing over a road on which the first vehicle is traveling straight and is approaching to the first vehicle.

17. The first terminal device according to claim 1, wherein one of the second plurality of the driving supports includes a notification to the driver of the first vehicle of a presence of the second vehicle ahead to the first vehicle, in a case where it is determined that the first vehicle is about to collide with the second vehicle.

* * * * *